US009372424B2

(12) United States Patent
Matsui et al.

(10) Patent No.: US 9,372,424 B2
(45) Date of Patent: Jun. 21, 2016

(54) TONER

(71) Applicant: CANON KABUSHIKI KAISHA, Tokyo (JP)

(72) Inventors: Takashi Matsui, Mishima (JP); Yusuke Hasegawa, Suntou-gun (JP); Shuichi Hiroko, Tokyo (JP); Yoshitaka Suzumura, Mishima (JP); Atsuhiko Ohmori, Suntou-gun (JP); Keisuke Tanaka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 14/567,991

(22) Filed: Dec. 11, 2014

(65) Prior Publication Data

US 2015/0168859 A1 Jun. 18, 2015

(30) Foreign Application Priority Data

Dec. 17, 2013 (JP) ..... 2013-260383

(51) Int. Cl.

| | |
|---|---|
| ***G03G 9/097*** | (2006.01) |
| ***G03G 9/083*** | (2006.01) |
| ***G03G 9/087*** | (2006.01) |

(52) U.S. Cl.
CPC ..... *G03G 9/0836* (2013.01); *G03G 9/08782* (2013.01); *G03G 9/09725* (2013.01)

(58) Field of Classification Search
USPC ..... 430/108.6, 108.7, 110.1, 110.3
See application file for complete search history.

(56) References Cited

FOREIGN PATENT DOCUMENTS

| | | | |
|---|---|---|---|
| JP | H10-239897 | A | 9/1998 |
| JP | 2012-014167 | A | 1/2012 |
| JP | 2012-047771 | A | 3/2012 |

*Primary Examiner* — Peter Vajda
(74) *Attorney, Agent, or Firm* — Canon U.S.A., Inc., IP Division

(57) ABSTRACT

A magnetic toner contains magnetic toner particles and silica fine particles. The magnetic toner has a thermal conductivity in the range of 0.230 to 0.270 W/(m·K). Primary particles of the silica fine particles have a number-average particle diameter (D1) in the range of 5 to 20 nm. The coverage X1 of the magnetic toner surface by the silica fine particles ranges from 40% to 75% by area as determined using an X-ray photoelectron spectrometer (ESCA). The diffusion index (X1/X2) satisfies the following formula:

$$\text{Diffusion index} \geq -0.0042 \times X1 + 0.62$$

wherein X2 denotes the theoretical coverage of the magnetic toner surface by the silica fine particles.

4 Claims, 3 Drawing Sheets

TONER

BACKGROUND OF THE INVENTION

1. Field of the Invention

The present invention relates to a toner for use in electrophotography, an electrostatic recording method, a magnetic recording method, and other methods.

2. Description of the Related Art

In recent years, analog printers and copying machines have been replaced with digital printers and copying machines. Thus, there is a strong demand for high reproducibility of latent images and high resolution, as well as stability in long-term use and improved energy conservation. In order to improve energy conservation, it is important to reduce the power consumption of copying machines and printers in a fixing process. Power consumption can be effectively reduced by using film fixing and by lowering the fixing temperature. In the film fixing, use of a film improves thermal conductivity and thereby tends to lower power consumption.

A low fixing temperature in film fixing often causes a problem of "low-temperature offset", in which because of insufficient releasability between toner and a film during fixing, the toner cannot be fixed to a medium, such as a paper sheet, and part of the toner remains on the film.

Another problem in jumping development, which is magnetic single component development, is low-temperature offset associated with "sweeping". Sweeping is a phenomenon in which the amount of developed toner at an edge of an image area increases in a boundary region between the image area and a non-image area because electric lines of force extend toward the edge of the image area. Sweeping often occurs in jumping development.

For example, in an image that includes a line and a solid in combination, since the effect of edges is greater in the line area than in the solid area, the amount of developed toner tends to be increased by sweeping. Thus, low-temperature offset is more likely to occur in the line area than in the solid area.

Various attempts have been made to prevent low-temperature offset by using particular toners. Japanese Patent Laid-Open Nos. 2012-47771, 2012-014167, and 10-239897 describe improvements in low-temperature offset from the perspective of the dispersibility of a magnetic material in a magnetic toner.

In any of these magnetic toners, although the thermal conductivity of the magnetic toner increases with the dispersibility of the magnetic material in the magnetic toner, the thermal conductivity is still insufficient. Furthermore, sweeping is not fully discussed in these patents. Thus, there is room for improvement in low-temperature offset.

SUMMARY OF THE INVENTION

The present invention is directed to providing a magnetic toner that can solve the aforementioned problems.

More specifically, the present invention is directed to providing a magnetic toner that can produce a consistent optical density in long-term use and is less likely to cause low-temperature offset.

The present inventors have completed the present invention by finding that the consistent optical density in long-term use and the suppression of low-temperature offset can be achieved by specifying the type of fine inorganic particles, the surface state of magnetic toner particles covered with the fine inorganic particles, and the thermal conductivity of the magnetic toner. The following are some aspects of the present invention.

According to one aspect of the present invention, there is provided a magnetic toner, comprising: magnetic toner particles, each of which contains a binder resin, a magnetic material, and a release agent; and fine inorganic particles, wherein the magnetic toner has a thermal conductivity in the range of 0.230 to 0.270 W/(m·K), the fine inorganic particles are silica fine particles, primary particles of the silica fine particles have a number-average particle diameter (D1) in the range of 5 to 20 nm, the coverage X1 of the magnetic toner surface by the silica fine particles ranges from 40.0% to 75.0% by area as determined using an X-ray photoelectron spectrometer (ESCA), and the diffusion index represented by the following formula 1 satisfies the following formula 2:

$$\text{Diffusion index}=X1/X2 \quad (1)$$

$$\text{Diffusion index}\geq -0.0042\times X1+0.62 \quad (2)$$

wherein X2 denotes the theoretical coverage of the magnetic toner surface by the silica fine particles.

Further features of the present invention will become apparent from the following description of exemplary embodiments with reference to the attached drawings.

DESCRIPTION OF THE EMBODIMENTS

Figure 1:
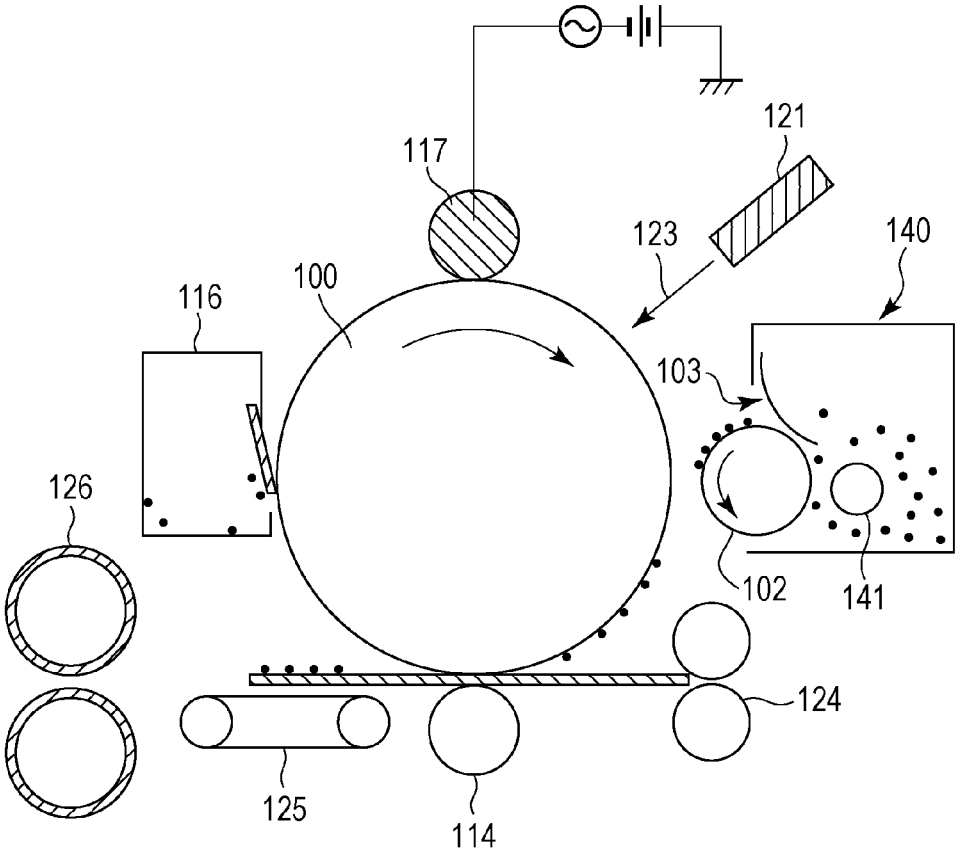
FIG. 1 is a schematic view of an image-forming apparatus.

The present invention will be described in detail below.

The present invention relates to a magnetic toner (hereinafter also referred to simply as a toner), comprising: magnetic toner particles containing a binder resin, a magnetic material, and a release agent; and fine inorganic particles, wherein the magnetic toner has a thermal conductivity in the range of 0.230 to 0.270 W/(m·K), the fine inorganic particles are silica fine particles, primary particles of the silica fine particles have a number-average particle diameter (D1) in the range of 5 to 20 nm, the coverage X1 of the magnetic toner surface by the silica fine particles ranges from 40% to 75% by area as determined using an X-ray photoelectron spectrometer (ESCA), and the diffusion index represented by the following formula 1 satisfies the following formula 2:

$$\text{Diffusion index}=X1/X2 \quad (1)$$

$$\text{Diffusion index}\geq -0.0042\times X1+0.62 \quad (2)$$

wherein X2 denotes the theoretical coverage of the magnetic toner surface by the silica fine particles.

The present inventors found that such a magnetic toner can produce a consistent optical density in long-term use and is less likely to cause low-temperature offset.

First, the cause of low-temperature offset will be described below.

The behavior during fixing is as follows:

[1] While an unfixed toner on a transfer material passes through a fixing nip portion between a fixing roller or a fixing film and a pressure roller, toner particles are melted, deformed, and bound together. Simultaneously, the unfixed toner is fixed to the transfer material by anchoring. While the unfixed toner passes through the fixing nip portion, a release agent in the toner may bleed from the toner surface.

[2] After the toner passes through the fixing nip, the toner is separated from the fixing film and is fixed to a paper sheet.

In such behavior during fixing, the following two factors may be responsible for low-temperature offset.

1. Insufficient toner fusion in the fixing nip portion results in insufficient anchoring to the transfer material.

2. After the toner passes through the fixing nip, the toner is not separated from the fixing member and adheres to the fixing member.

Low-temperature offset associated with "sweeping" will be described below. As described above, sweeping is a phenomenon in which the amount of developed toner at an edge increases, and sweeping often occurs in jumping development.

In order to suppress low-temperature offset, in addition to the control of the behaviors [1] and [2] during fixing, it is important to control the amount of unfixed toner to be developed.

Thus, the present inventors made extensive studies in order to suppress low-temperature offset associated with "sweeping".

As a result, the present inventors found that the problems described above can be solved by increasing the thermal conductivity of a magnetic toner and by controlling the coverage of the magnetic toner particle surface by fine inorganic particles and the diffusion state of the fine inorganic particles.

Consideration will be given below in the order of the behaviors during fixing.

First, it is supposed that in an ideal state of an unfixed image on a medium, such as a paper sheet, there is a little difference in toner bearing amount between a line area and a solid area, and therefore sweeping is less likely to occur. Furthermore, the ideal state of the unfixed image on the medium, such as a paper sheet, is close to a closest packing state.

A magnetic toner according to an embodiment of the present invention has optimized coverage of the magnetic toner particle surface by fine inorganic particles and optimized diffusion of the fine inorganic particles. A toner having optimized coverage with fine inorganic particles and optimized diffusion of the fine inorganic particles has a structure in which a uniform layer of the fine inorganic particles is formed on the toner particle surface. Such a toner has weak van der Waals force, resulting in low adhesion strength between magnetic toner particles. Thus, a proper amount of magnetic toner can be developed on a latent image formed on an image-bearing member, thus resulting in less sweeping and a small difference in the amount of developed toner in a line area and a solid area.

In a magnetic toner according to an embodiment of the present invention, in addition to the weak van der Waals force, silica particles can easily come into contact with each other. This can further reduce the aggregation of the magnetic toner due to the bearing (slippage) effect of the silica particles. Thus, the magnetic toner on the unfixed image transferred from the image-bearing member to the medium, such as a paper sheet, does not aggregate, remains loose, and is in a state close to the closest packing.

When a transfer material that bears an unfixed image passes through a fixing nip, a small difference in the bearing amount between a line area and a solid area of the unfixed image and a state close to the closest packing facilitate uniform heat or pressure transfer to the magnetic toner. Furthermore, because of its high thermal conductivity, a magnetic toner according to an embodiment of the present invention can be instantaneously heated and has a significantly improved sharp melt property. These synergistic effects unprecedentedly improve low-temperature offset.

It is also found that a magnetic toner according to an embodiment of the present invention can maintain stability in long-term use. This is probably because of the following reason.

Since a magnetic toner according to an embodiment of the present invention is uniformly and sufficiently covered with an external additive, the magnetic toner particles have low cohesiveness therebetween and low adhesiveness to peripheral members. Thus, the magnetic toner rarely suffers excessive stress and degradation in triboelectrification in a developing unit. The magnetic toner therefore rarely suffers degradation in long-term use and improves image stability.

A magnetic toner according to an embodiment of the present invention will be more specifically described below.

A magnetic toner according to an embodiment of the present invention has a thermal conductivity in the range of 0.230 to 0.270 W/(m·K). This thermal conductivity can be achieved by optimizing the type and amount of magnetic material in the magnetic toner, the state of the magnetic material, and the molecular structure of a binder resin of the magnetic toner.

When the magnetic toner has a thermal conductivity of 0.230 W/(m·K) or more, the magnetic toner can be instantaneously heated during fixing and have satisfactory low-temperature offset. The toner should contain a thermally-conductive component, such as a metallic material, in order to increase the thermal conductivity thereof. However, a large amount of thermally-conductive component may cause a problem with respect to fixability. Thus, the practical upper limit of the thermal conductivity of the magnetic toner is 0.270 W/(m·K).

The silica fine particles on the toner particle surface will be described below.

The silica fine particles on the surface of a magnetic toner according to an embodiment of the present invention has a number-average primary particle diameter in the range of 5 to 20 nm. The silica fine particles on the toner surface can improve toner flowability and facilitates the formation of a dense state like the closest packing state of the toner on an unfixed image. The silica fine particles can also suppress toner deterioration in long-term use.

In a magnetic toner according to an embodiment of the present invention, the coverage X1 of the toner surface by the silica fine particles ranges from 40% to 75% by area as determined using an X-ray photoelectron spectrometer (ESCA). The diffusion index represented by the following formula 1 satisfies the following formula 2:

$$\text{Diffusion index} = X1/X2 \quad (1)$$

$$\text{Diffusion index} \geq -0.0042 \times X1 + 0.62 \quad (2)$$

The coverage X1 can be calculated from the ratio of the detected intensity of Si in the ESCA measurement of the toner to the detected intensity of the Si in the ESCA measurement of the silica fine particles alone. The coverage X1 represents the area percentage of a portion of the toner particle surface covered with the silica fine particles.

A coverage X1 in the range of 40% to 75% by area tends to result in low adhesion strength between toner particles and between the toner and another member. This can reduce the difference in toner coverage between a line area and a solid area in an image. This also facilitates the formation of a dense state like the closest packing state of toner on an unfixed image. This can also suppress toner deterioration and improve the stability of toner in long-term use.

The theoretical coverage X2 with the silica fine particles is calculated using the following formula 4 from the parts by mass of the silica fine particles per 100 parts by mass of toner particles and the particle diameter of the silica fine particles. The theoretical coverage X2 represents the area percentage of a portion of the toner particle surface theoretically covered with the silica fine particles.

$$\text{Theoretical coverage } X2(\%\text{ by area})=3^{1/2}/(2\pi)\times(dt/da)\times(\rho t/\rho a)\times C\times 100 \quad (4)$$

da: Number-average particle diameter of silica fine particles (D1)

dt: Weight-average particle diameter of toner (D4)

ρa: True specific gravity of silica fine particles

ρt: True specific gravity of toner

C: Mass of silica fine particles/mass of toner (=parts of silica fine particles added per 100 parts by mass of toner particles (parts by mass)/(parts of silica fine particles added per 100 parts by mass of toner particles (parts by mass)+100 (parts by mass)))

(When the number of silica fine particles is unknown, "C" is used in accordance with a method for measuring the "silica fine particle content of toner" described below.)

The physical meaning of the diffusion index represented by the formula 1 will be described below.

The diffusion index indicates a discrepancy between the measured coverage X1 and the theoretical coverage X2. The discrepancy is supposed to indicate the number of silica fine particles stacked in two or more layers in a direction perpendicular to the toner particle surface. Ideally, the diffusion index is 1, which means that the coverage X1 is equal to the theoretical coverage X2, and there is no stack of silica fine particles. The presence of aggregates of silica fine particles on the toner surface causes a discrepancy between the measured coverage and the theoretical coverage and lowers the diffusion index. In other words, the diffusion index indicates the number of aggregates of silica fine particles.

In an embodiment of the present invention, it is important that the diffusion index is in the range represented by the formula 2. This range is greater than that of toners manufactured by using conventional techniques. A higher diffusion index indicates a smaller number of aggregates of silica fine particles and a larger number of primary particles on the toner particle surface. As described above, the upper limit of the diffusion index is 1.

The diffusion index threshold in an embodiment of the present invention is a function of the coverage X1 in the range of 40% to 75% by area. The function was empirically deduced from the loosening ability of toner when the coverage X1 and the diffusion index were determined by changing the number of silica fine particles and the external addition conditions.

Figure 2:
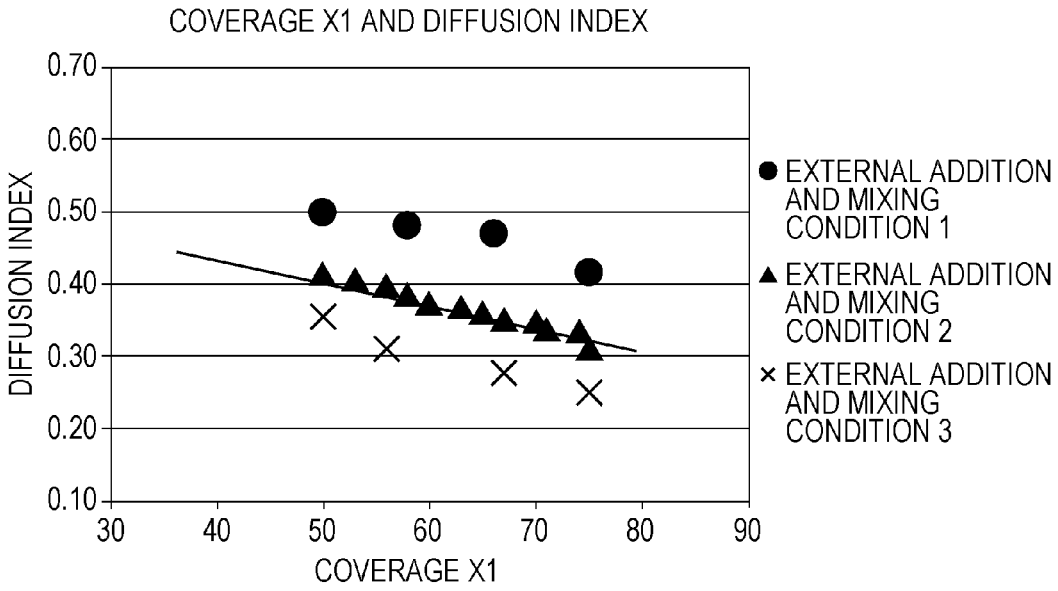
FIG. 2 is a graph showing a diffusion index threshold.

FIG. 2 is a graph showing the relationship between the coverage X1 and the diffusion index in the manufacture of toners having different coverages. The coverage X1 was changed by increasing or decreasing the number of silica fine particles under three different external addition and mixing conditions. Among the toners shown in the graph, toners in a region that satisfies the formula 2 were found to have sufficiently improved loosening ability when pressed.

The reason for the dependence of the diffusion index on the coverage X1 is not clear but may be as described below. Although the number of secondary particles of silica fine particles can be as small as possible, the coverage X1 has no small effect on the number of secondary particles. With an increase in the coverage X1, the loosening ability of toner increases, and the acceptable number of secondary particles of silica fine particles increases. Thus, the diffusion index threshold is a function of the coverage X1. In other words, the coverage X1 correlates with the diffusion index. Thus, this experiment shows that it is important to control the diffusion index as a function of the coverage X1.

When the diffusion index is in the range represented by the following formula 5, this results in an increased number of aggregates of silica fine particles, toner deterioration, and low adhesion strength between toner particles and between the toner and another member. Thus, such an embodiment of the present invention cannot adequately have the intended advantages.

$$\text{Diffusion index}<-0.0042\times X1+0.62 \quad (5)$$

Various components of a magnetic toner according to an embodiment of the present invention will be described below.

First, the magnetic material will be described below.

The magnetic material is composed mainly of triiron tetroxide or γ-iron oxide and may contain phosphorus, cobalt, nickel, copper, magnesium, manganese, and/or aluminum. The magnetic material preferably has a BET specific surface area in the range of 2.0 to 20.0 $m^2/g$, more preferably 3.0 to 10.0 $m^2/g$, as determined using a nitrogen adsorption method.

The shape of the magnetic material may be polyhedral, octahedral, hexahedral, spherical, spicular, or flaky. In order to increase optical density, the shape of the magnetic material can be less anisotropic, such as polyhedral, octahedral, hexahedral, or spherical. The magnetic material preferably has a volume-average particle diameter (Dv) in the range of 0.10 to 0.40 μm in terms of toner dispersibility and tint.

The volume-average particle diameter (Dv) of a treated magnetic material can be measured using a transmission electron microscope. More specifically, toner particles to be observed are well dispersed in an epoxy resin. The epoxy resin is cured at a temperature of 40° C. for 2 days to produce a cured product. A thin sample is taken from the cured product using a microtome and is photographed using a transmission electron microscope (TEM) at a magnification in the range of 10,000 to 40,000. The particle diameter of 100 particles of the treated magnetic material in the visual field is measured. The volume-average particle diameter (Dv) is calculated from the diameter of a circle having an area that is equal to the projected area of the treated magnetic material (circle-equivalent diameter). The particle diameter may be measured using an image analyzing apparatus.

The magnetic material content of a magnetic toner according to an embodiment of the present invention ranges from 70 to 100 parts by mass per 100 parts by mass of the binder resin. A magnetic material content of 70 parts by mass or more tends to result in improved thermal conductivity of the magnetic toner. A magnetic material content of 70 parts by mass or more also tends to result in improved optical density. A magnetic material content of 100 parts by mass or less tends to facilitate deformation of the toner during fixing and results in improved low-temperature offset.

The magnetic material content of toner can be measured using a thermal analysis system TGA7 manufactured by PerkinElmer, Inc. The measurement method is described below. Toner is heated from normal temperature to 900° C. at a heating rate of 25° C./min in a nitrogen atmosphere. A decrease in mass while the temperature increases from 100° C. to 750° C. is considered to be the amount of binder resin, and the residual mass is approximately considered to be the amount of treated magnetic material.

The magnetic material in each of toner particles can be adjacent to each other and form a network structure. Such a magnetic toner having a network structure may be a magnetic toner having a "mag-shell" structure. The "mag-shell" structure refers to a structure in which a magnetic material is disposed in the vicinity of the toner surface. Such a magnetic toner having a "mag-shell" structure can be manufactured by subjecting a magnetic material to a desired hydrophobic treatment and performing suspension polymerization. A network structure of adjacent magnetic materials in toner as in the mag-shell structure allows heat to be effectively transferred within toner particles, thereby promoting the melting of the toner and the bleeding of a release agent. Furthermore, a magnetic material in the vicinity of the toner surface as in the mag-shell structure can facilitate heat transfer between toner particles. This allows heat to be efficiently transferred over the entire unfixed image. Thus, a magnetic toner on the medium side, which is distant from the fixing film side on which a heat source is disposed, can be effectively heated, thereby improving anchoring to the medium and low-temperature offset.

A magnetic material suitable for a method for manufacturing magnetic toner particles by suspension polymerization according to an embodiment of the present invention will be described below.

In a method for manufacturing a magnetic toner by suspension polymerization according to an embodiment of the present invention, a monomer composition containing a magnetic material is dispersed and granulated in an aqueous medium, and a polymerizable monomer in the granulated particles is polymerized. The surface of the magnetic material is subjected to a hydrophobic treatment so that the magnetic material is not exposed to the aqueous medium. Exposure of the magnetic material to the aqueous medium impairs the granulation of the magnetic toner, the particle size distribution, and the inclusion of the magnetic material in toner particles.

This is because untreated magnetic materials are generally hydrophilic because of a functional group, such as a hydroxy group, disposed on the surface thereof.

Generally known surface-treating agents are silane compounds, titanate compounds, and aluminate compounds. These surface-treating agents are hydrolyzed and form a strong chemical bond with hydroxy groups on the magnetic material surface through a condensation reaction, thereby exhibiting hydrophobic properties. However, it is known that these compounds after hydrolysis tend to undergo self-condensation and form a polymer or oligomer. However, silane compounds under controlled hydrolysis conditions can undergo controlled self-condensation while having a high rate of hydrolysis. Thus, silane compounds can be used to uniformly treat the magnetic material surface. This is probably because silicon of silane compounds has lower activity than titanium or aluminum. A magnetic material having a surface uniformly treated with a silane compound can be adjacent to each other in toner particles and easily form a network structure.

A silane compound having a C6-C10 hydrocarbon group can be used.

This is probably because the hydrophobic properties of a magnetic material, which are related to the inclusion of the magnetic material, depend on the length of a hydrocarbon group of silane compounds.

The length of a hydrocarbon group correlates closely with the number of carbon atoms. The study by the present inventors showed that the number of carbon atoms in the range of 6 to 10 results in particularly improved thermal conductivity of a magnetic toner.

Although the reason for the improved thermal conductivity is not clear, this is probably because the number of carbon atoms in the range of 6 to 10 results in a high magnetic material content of toner, thereby allowing the magnetic material to be adjacent to each other and form a network structure in the toner.

Even when the number of carbon atoms of the hydrocarbon group is four, the surface treatment can be optimized to improve the thermal conductivity of the magnetic toner. For example, in a dry surface treatment as described below, the amount of surface-treating agent is optimized to well mix the surface-treating agent with a magnetic material in a mixing process and thereby uniformly cover the magnetic material surface with the surface-treating agent. Furthermore, in a drying process of allowing the surface-treating agent to adhere to the magnetic material, the surface treatment is optimized by optimizing the drying temperature or by drying the mixture while mixing the mixture to prevent aggregation of the magnetic material.

A silane compound for treating a magnetic material for use in a method for manufacturing a magnetic toner can be an alkoxysilane subjected to hydrolysis treatment. The rate of hydrolysis of the alkoxysilane can be 50% or more.

In general, silane compounds are directly treated without hydrolysis. Such silane compounds cannot form a chemical bond with hydroxy groups on the magnetic material surface and only have strength similar to physical bonding strength. Under such conditions, silane compounds can be easily detached by shear stress in the manufacture of toner or by the action of polymerizable monomers.

In the surface treatment, heating is generally preceded by the addition and mixing of a silane compound. However, the present inventors found that unhydrolyzed silane compounds volatilize from the magnetic material surface at a temperature in the range of approximately 100° C. to 120° C. Thus, hydroxy groups and silanol groups remain on the magnetic material surface after the silane compounds volatilize, and high hydrophobic properties are rarely achieved.

For these reasons, a silane compound in an embodiment of the present invention can be an alkoxysilane subjected to hydrolysis treatment. A silane compound subjected to hydrolysis treatment adheres to the magnetic material surface through a hydrogen bond between the silane compound and a hydroxy group on the magnetic material surface. The hydrogen bond is heated and dehydrated to form a strong chemical bond. The hydrogen bond can prevent the silane compound from volatilizing by heating and improve the hydrophobic properties. For these reasons, in an embodiment of the present invention, the rate of hydrolysis of a silane compound is preferably 50% or more, more preferably 90% or more.

When the rate of hydrolysis of a silane compound is 50% or more, the magnetic material surface can be treated with various types of surface-treating agents for the reasons described above. Furthermore, this can improve the uniformity of the surface treatment and the dispersibility of the magnetic material. Thus, the present inventors suppose that when the rate of hydrolysis of a silane compound is 50% or more, this results in a high magnetic material content of toner and allows the magnetic material to be adjacent to each other and form a network structure in the toner, thereby improving the thermal conductivity of the magnetic toner.

The rate of hydrolysis of a silane compound is calculated by subtracting the percentage of residual alkoxy groups from 100%. The rate of hydrolysis is 100% when an alkoxysilane is completely hydrolyzed.

An alkoxysilane can be hydrolyzed as described below. More specifically, an alkoxysilane is gradually added to an aqueous solution or a mixed solution of an alcohol and water at a pH in the range of 4.0 to 6.5 and is uniformly dispersed using dispersing impellers. The temperature of the dispersion liquid preferably ranges from 35° C. to 50° C. In general, alkoxysilanes are more easily hydrolyzed at a lower pH and at a higher liquid temperature. Under such conditions, however, alkoxysilanes also more easily undergo self-condensation. Thus, a magnetic material uniformly subjected to hydrophobic treatment suitable for an embodiment of the present invention cannot be produced using a silane compound under such conditions.

As described above, it is very difficult to hydrolyze an alkoxysilane while preventing the self-condensation of the alkoxysilane. As a result of extensive studies, the present inventors found that even under difficult conditions for hydrolysis (or self-condensation), a high-shear dispersing apparatus, such as dispersing impellers, can be used to increase the contact area between an alkoxysilane and water and thereby efficiently promote the hydrolysis of the alkoxysilane. Thus, the rate of hydrolysis can be increased while suppressing the self-condensation.

Methods for surface treatment of magnetic materials are divided into two: a dry process and a wet process. In dry surface treatment, a silane compound is added to a dried magnetic material, and the dried magnetic material is subjected to surface treatment in a gas phase. In wet surface treatment, a dried magnetic material is redispersed in an aqueous medium, or after the completion of an oxidation reaction, undried iron oxide is redispersed in another aqueous medium, and then the surface treatment is performed using a silane compound.

A magnetic material for use in an embodiment of the present invention can be a magnetic material subjected to surface treatment using a silane compound in a gas phase (hereinafter also referred to as a dry method).

Surface treatment of a magnetic material in a gas phase (hereinafter also referred to as a dry method) can easily increase the amount of residual carbon derived from a silane compound described below and can therefore impart satisfactory hydrophobic properties to the magnetic material. This can result in improved dispersibility of the magnetic material, uniform distribution of the magnetic material from the toner surface, and improved thermal conductivity of the magnetic toner.

An apparatus for the surface treatment of magnetic materials can be a known mixer. More specifically, a Henschel mixer (Mitsui Miike Machinery Co., Ltd.), a high-speed mixer (Fukae Powtec Corporation), or a hybridizer (Nara Machinery Co., Ltd.) can be used.

A magnetic material that is used in a method for manufacturing a magnetic toner manufactured in accordance with an embodiment of the present invention can contain silicon on the surface thereof. Silicon can improve an affinity of the magnetic material surface for a silane compound and improve the uniformity of treatment with the silane compound. A high affinity of the magnetic material surface for a silane compound results in an increased amount of silane compound bound to the magnetic material surface.

For this reason, in an embodiment of the present invention, a particular amount of silicon can be present on the magnetic material surface and in the vicinity thereof. More specifically, the magnetic material is dispersed and dissolved in an aqueous hydrochloric acid such that the dissolution rate of elemental iron is 5% by mass of the total amount of elemental iron in the magnetic material. At this point, the elution of silicon preferably ranges from 0.05% to 0.50% by mass of the magnetic material.

When the dissolution rate of elemental iron of an magnetic material is 100% by mass, this means that the magnetic material is completely dissolved. The dissolution rate closer to 100% by mass indicates that the dissolution is closer to the complete dissolution. As a result of extensive studies, the present inventors found that magnetic materials are uniformly dissolved from the surface thereof under acidic conditions.

Thus, the amount of element eluted up to the point in time when the dissolution rate of elemental iron is 5% by mass is supposed to be the amount of element present on the magnetic material surface and in the vicinity thereof. When the amount of silicon present on a magnetic material surface and in the vicinity thereof is 0.05% by mass or more, this can result in a high affinity of the magnetic material surface for a silane compound, improved uniformity of treatment, improved dispersibility of the magnetic material in toner, and improved thermal conductivity of the magnetic toner.

When the amount of silicon present on a magnetic material surface and in the vicinity thereof is 0.50% by mass or less, the hydrophobicity of the magnetic material can be easily improved. Improved hydrophobicity of the magnetic material can result in uniform distribution of the magnetic material from the toner surface and improved thermal conductivity of the magnetic toner.

The possible reason for this is described below.

One molecule of a silane compound for use in the surface treatment of a magnetic material has a specific coverage area. Thus, the maximum amount of condensable silane compound per unit area depends on the coverage area. For this reason, a silicon content of more than 0.50% by mass results in an excessive amount of residual silicon and silanol groups derived therefrom on the magnetic material surface. Thus, the magnetic material surface has high adsorbability for water and low hydrophobicity.

The surface conditions of such a magnetic material should be controlled in consideration of a magnetic toner manufacturing process according to an embodiment of the present invention.

For example, the amount of silane compound on the magnetic material surface must be maintained even in a polymerizable monomer, such as styrene. As a result of extensive studies, the present inventor found that the amount of residual carbon derived from the silane compound after washing with styrene preferably ranges from 0.40% to 1.2% by mass of the magnetic material. Washing with styrene allows the amount of silane compound adhered to the surface of a magnetic toner manufactured by using a method for manufacturing a magnetic toner by suspension polymerization according to an embodiment of the present invention to be estimated from the amount of residual carbon.

This is probably because hydrocarbon groups are important for the silane compound to exhibit hydrophobic properties, that is, the amount of carbon is effective in estimating the hydrophobicity of the magnetic material.

When the amount of adhered carbon is 0.40% by mass or more, this tends to result in sufficient hydrophobic properties. Improved hydrophobicity of the magnetic material tends to result in improved dispersibility of the magnetic material in toner and improved thermal conductivity of the magnetic toner.

When the amount of residual carbon derived from the silane compound after washing with styrene is 1.2% by mass or less, this tends to result in uniform coatability of a surface-treating agent and improved uniformity of the surface treatment. This tends to result in improved dispersibility of the magnetic material in toner particles, less variations in the state of the magnetic material between the toner particles, and improved thermal conductivity of the magnetic toner.

A treated magnetic material for use in a method for manufacturing a magnetic toner according to an embodiment of the present invention can be produced by using the following method. First, an alkali, such as sodium hydroxide, is added to an aqueous iron (II) salt to prepare an aqueous solution containing iron (II) hydroxide. The amount of the alkali is at least equivalent to the amount of the iron component. While the pH of the aqueous solution is maintained at 7.0 or more, air is blown into the aqueous solution at 70° C. or more to perform an oxidation reaction of the iron (II) hydroxide, thereby forming seed crystals, which serve as cores of magnetic material particles. An aqueous solution containing iron (II) sulfate is then added to the slurry containing the seed crystals. The amount of the iron (II) sulfate is approximately 1 equivalent based on the amount of the alkali. While the pH of the solution is maintained in the range of 5.0 to 10.0, air is blown into the solution to allow the iron (II) hydroxide to react, thereby growing magnetic material particles using the seed crystals as cores. The shape and magnetic characteristics of the magnetic material can be controlled by changing the pH of the solution, the reaction temperature, and the stirring conditions. Although the pH of the solution decreases as the oxidation reaction proceeds, the pH of the solution is preferably 5.0 or more. After the completion of the oxidation reaction, a silicon source, such as sodium silicate, is added to the solution to control the pH of the solution in the range of 5.0 to 8.0. In this way, a silicon covering layer is formed on the surfaces of magnetic material particles. The magnetic material particles thus produced are filtered, washed, and dried using routine methods to produce a magnetic material.

The amount of silicon on the magnetic material surface can be controlled by changing the amount of sodium silicate added to the solution after the completion of the oxidation reaction.

The magnetic material is then subjected to the hydrophobic treatment. Examples of silane compounds that can be used in the surface treatment of the magnetic material include, but are not limited to, silane compounds represented by the general formula (1):

$$R_mSiY_n \quad (1)$$

wherein R denotes an alkoxy group or a hydroxy group, m denotes an integer in the range of 1 to 3, Y denotes an alkyl group or a vinyl group, the alkyl group optionally having a functional group, such as an amino group, hydroxy group, epoxy group, acryl group, and/or methacryl group, as a substituent, and n denotes an integer in the range of 1 to 3, provided that m+n=4.

Examples of the silane compounds represented by the general formula (1) include, but are not limited to, vinyltrimethoxysilane, vinyltriethoxysilane, vinyl tris(β-methoxyethoxy)silane, β-(3,4-epoxycyclohexyl) ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane, n-octadecyltrimethoxysilane, and hydrolysates thereof.

These silane compounds may be used alone or in combination. When these silane compounds are used in combination, the silane compounds may be separately or simultaneously used. Among these, use of n-hexyltrimethoxysilane, n-octyltrimethoxysilane, n-octyltriethoxysilane, and/or n-decyltrimethoxysilane tends to result in uniform surface coating and improved hydrophobic properties.

A toner according to an embodiment of the present invention can contain a colorant so as to have the target tint. A colorant for use in a toner according to an embodiment of the present invention may be a known organic pigment or dye, carbon black, or magnetic material.

The binder resin will be described below.

A binder resin for use in a magnetic toner according to an embodiment of the present invention can be a styrene resin.

Use of a styrene resin as a binder resin facilitates the adjustment of the ratio [Rw/Mw] of the average radius of gyration (Rw) to the weight-average molecular weight (Mw) of a magnetic toner according to an embodiment of the present invention in the desired range. The ratio [Rw/Mw] is determined by using size exclusion chromatography-multi-angle laser light scattering (SEC-MALLS).

Specific examples of the styrene resin include polystyrene and styrene copolymers, such as a styrene-propylene copolymer, styrene-vinyltoluene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-octyl methacrylate copolymer, styrene-butadiene copolymer, styrene-isoprene copolymer, styrene-maleic acid copolymer, and styrene-maleate copolymers. These styrene resins may be used alone or in combination.

Among these, a styrene-butyl acrylate copolymer and a styrene-butyl methacrylate copolymer can satisfy both developing characteristics and low-temperature offset because the degree of branching and the resin viscosity are easy to control.

Although the binder resin for use in a magnetic toner according to an embodiment of the present invention can be a styrene resin, the styrene resin may be used in combination with the following resin, provided that the advantages of the present invention are not compromised.

For example, the styrene resin may be used in combination with at least one of poly(methyl methacrylate), poly(butyl methacrylate), poly(vinyl acetate), polyethylene, polypropylene, poly(vinyl butyral), silicone resin, polyester resin, polyamide resin, epoxy resin, and poly(acrylic acid) resin.

Examples of monomers for producing the styrene resin include, but are not limited to:

styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; unsaturated monoolefins, such as ethylene, propylene, butylene, and isobutylene; unsaturated polyenes, such as butadiene and isoprene; vinyl halides, such as vinyl chloride, vinylidene chloride, vinyl bromide, and vinyl fluoride; vinyl esters, such as vinyl acetate, vinyl propionate, and vinyl benzoate; α-methylene aliphatic monocarboxylate esters, such as methyl methacrylate, ethyl methacrylate, propyl methacrylate, methacrylic acid n-butyl, isobutyl methacrylate, methacrylic acid n-octyl, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinylpyrrolidone; vinylnaphthalene; and acrylic acid or methacrylic acid derivatives, such as acrylonitrile, methacrylonitrile, and acrylamide;

unsaturated dibasic acids, such as maleic acid, citraconic acid, itaconic acid, alkenylsuccinic acid, fumaric acid, and mesaconic acid; unsaturated dibasic acid anhydrides, such as maleic acid anhydride, citraconic acid anhydride, itaconic acid anhydride, and alkenylsuccinic acid anhydride; unsaturated dibasic acid half esters, such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester, and mesaconic acid methyl half ester; unsaturated dibasic acid esters, such as dimethyl maleate and dimethyl fumarate; α,β-unsaturated acid, such as acrylic acid, methacrylic acid, crotonic acid, and cinnamic acid; α,β-unsaturated acid anhydride, such as crotonic acid anhydride and cinnamic acid anhydride, and anhydrides of the α,β-unsaturated acids and lower fatty acids; and monomers having a carboxy group, such as alkenyl malonic acids, alkenyl glutaric acids, and alkenyl adipic acids, and acid anhydrides and monoesters thereof; and acrylates and methacrylates, such as 2-hydroxyethyl acrylate, 2-hydroxyethyl methacrylate, and 2-hydroxypropyl methacrylate; and monomers having a hydroxy group, such as 4-(1-hydroxy-1-methylbutyl)styrene and 4-(1-hydroxy-1-methylhexyl)styrene.

A styrene resin used as a binder resin in a magnetic toner according to an embodiment of the present invention may have a cross-linked structure formed by using a crosslinking agent having two or more vinyl groups. Examples of the crosslinking agent include, but are not limited to:

aromatic divinyl compounds, such as divinylbenzene and divinylnaphthalene;

diacrylate compounds having an alkyl main chain, such as ethylene glycol diacrylate, 1,3-butylene glycol diacrylate, 1,4-butanediol diacrylate, 1,5-pentanediol acrylate, 1,6-hexanediol diacrylate, and neopentyl glycol diacrylate, and their corresponding dimethacrylate compounds;

diacrylate compounds having an alkyl main chain having an ether bond, such as diethylene glycol diacrylate, triethylene glycol diacrylate, tetraethylene glycol diacrylate, polyethylene glycol 400 diacrylate, polyethylene glycol 600 diacrylate, and dipropylene glycol diacrylate, and their corresponding dimethacrylate compounds;

diacrylate compounds having a main chain having an aromatic group and an ether bond, such as polyoxyethylene(2)-2,2-bis(4-hydroxyphenyl)propane diacrylate and polyoxyethylene(4)-2,2-bis(4-hydroxyphenyl)propane diacrylate, and their corresponding dimethacrylate compounds; and polyester diacrylate compounds, such as MANDA (trade name, Nippon Kayaku Co., Ltd.).

Examples of polyfunctional crosslinking agents include, but are not limited to, pentaerythritol triacrylate, trimethylolethane triacrylate, trimethylolpropane triacrylate, tetramethylolmethane tetraacrylate, oligoester acrylate, their corresponding dimethacrylate compounds, triallyl cyanurate, and triallyl trimellitate.

The amount of crosslinking agent preferably ranges from 0.01 to 10 parts by mass, more preferably 0.03 to 5 parts by mass, per 100 parts by mass of the other monomer components.

Among these cross-linking monomers, aromatic divinyl compounds (particularly divinylbenzene) and diacrylate compounds having a main chain having an aromatic group and an ether bond can impart fixability and offset resistance to the binder resin.

A binder resin for use in a magnetic toner according to an embodiment of the present invention can have a low molecular weight. The branching of a molecular chain of a binder resin for use in a magnetic toner according to an embodiment of the present invention can be controlled. In other words, the tetrahydrofuran-soluble matter of a toner according to an embodiment of the present invention can have a substantially linear molecular structure rather than branched molecular structures.

The substantially linear molecular structure tends to result in improved thermal conductivity of the magnetic toner.

Although the reason for this is not clear, the low molecular weight and the substantially linear molecular chain structure probably result in a well-ordered molecular arrangement like a crystal structure and consequently improved heat transfer. The low molecular weight and the controlled branching of the molecular chain can improve thermoplasticity, facilitate sharp melting, and improve low-temperature offset.

A binder resin having a substantially linear molecular structure can be easily produced by using a suspension polymerization method. The state of the magnetic material can also be easily controlled by using a suspension polymerization method. Thus, toner particles can be manufactured by using a suspension polymerization method. Toner particles manufactured by using a suspension polymerization method can have high thermal conductivity.

The branching of a binder resin in a toner according to an embodiment of the present invention is specified by the branching of the tetrahydrofuran-soluble matter of the toner.

The tetrahydrofuran-insoluble matter can constitute 40% by mass or less of a binder resin in a toner according to an embodiment of the present invention from the perspective of stability in long-term use.

The tetrahydrofuran-soluble matter of a toner according to an embodiment of the present invention at 25° C. can have a weight-average molecular weight Mw in the range of 5,000 to 100,000 and a ratio Rw/Mw in the range of $5.0\times10^{-4}$ to $1.0\times10^{-2}$, as determined by size exclusion chromatography-multi-angle laser light scattering (SEC-MALLS). The Rw/Mw is the ratio of the average radius of gyration Rw (nm) to the weight-average molecular weight Mw.

The weight-average molecular weight Mw in this range tends to result in improved thermal conductivity, rapid melting during fixing, and a high optical density and image quality, even in long-term use.

A ratio Rw/Mw of $5.0\times10^{-4}$ or more indicates that a binder resin in toner has a linear molecular structure, thus resulting in high thermal conductivity and satisfactory low-temperature offset. A Rw/Mw of $1.0\times10^{-2}$ or less tends to result in the consistent manufacture of a toner and improved image stability of the toner in long-term use.

The average radius of gyration Rw preferably ranges from 20 to 70 nm. The average radius of gyration Rw in the range of 20 to 70 nm results in a binder resin having a low molecular weight. Thus, the degree of branching is easy to control.

The weight-average molecular weight Mw and the ratio Rw/Mw of the average radius of gyration Rw to the weight-average molecular weight Mw can be controlled by changing the type and amount of polymerization initiator and the reaction conditions as described below.

The size exclusion chromatography-multi-angle laser light scattering (SEC-MALLS) will be described below.

The abundance for each molecular size can be measured by SEC (common GPC). SEC-MALLS (an apparatus that includes SEC serving as a separation means and a multi-angle laser light scattering detector in combination) can measure a more actual molecular weight distribution of a mixed sample composed of molecules having the same molecular size by utilizing light scattering. The molecular weight distribution reflects differences in molecular structures, such as branching and cross-linking. SEC-MALLS can also measure the average radius of gyration Rw ($Rw=(Rg^2)^{1/2}$), which is the square root of the inertial square radius, which represents the spread of one molecule. SEC-MALLS allows the precise molecular design of toner.

In the known SEC method, molecules passing through a column are subjected to the molecule sieve effect and are eluted in decreasing order of molecular size, thereby allowing the measurement of molecular weight. When a linear polymer and a branched polymer have the same molecular weight, the linear polymer has a larger molecular size in solution than the branched polymer and is eluted faster than the branched polymer. Thus, the molecular weight of the branched polymer measured using the SEC method is smaller than the molecular weight measured using the SEC-MALLS method.

A light scattering method in an embodiment of the present invention utilizes the Rayleigh scattering of a molecule to be measured.

More actual molecular weights (absolute molecular weights) of all the molecular configurations of linear polymers and branched polymers can be determined by measuring the dependency of scattered light intensity on the incident angle of light and the sample concentration and analyzing the measurements using the Zimm method or the Berry method. In an embodiment of the present invention, the weight-average molecular weight (Mw) and the inertial square radius ($Rg^2$) based on the absolute molecular weight are determined by measuring the intensity of scattered light using a SEC-MALLS measurement method and analyzing the relationship represented by the following Zimm equation using the Debye plot. In the Debye plot, the axis of ordinates represents $K \cdot C/R(\theta)$, and the axis of abscissae represents $\sin^2(\theta/2)$. The weight-average molecular weight (Mw) is determined from the intercept on the axis of ordinates. The inertial square radius $Rg^2$ is determined from the slope.

The number-average molecular weight Mn, the weight-average molecular weight Mw, and the inertial square radius $Rg^2$ are measured for each component at each elution time. Thus, these measurements are averaged to determine the number-average molecular weight Mn, the weight-average molecular weight Mw, and the inertial square radius $Rg^2$ of the sample.

The number-average molecular weight (Mn), the weight-average molecular weight (Mw), and the average radius of gyration (Rw) of the sample can be directly determined using an apparatus described below.

[Equation 1]

$$\frac{K \cdot C}{R(\theta)} = \frac{1}{Mw} \cdot \frac{1}{P(\theta)} \approx \frac{1}{Mw}\left[1 + \langle Rg^2 \rangle \sin^2\left(\frac{\theta}{2}\right) \cdot 16\pi^2/3\lambda^2\right] \quad \text{Zimm equation}$$

K: Optical constant

C: Polymer concentration (g/ml)

R(θ): Relative intensity of scattered light at scattering angle θ

Mw: Weight-average molecular weight

P(θ): Factor that represents angular dependence of scattered light $$P(\theta)=R(\theta)/R_0=1-R[(4\pi/\lambda)\sin(\theta/2)]^2/3 \quad \text{[Equation 2]}$$

$\langle Rg^2 \rangle$: Inertial square radius

λ: Wavelength (nm) of laser light in solution

The inertial square radius $Rg^2$ generally indicates the spread of one molecule. The ratio Rw/Mw of the average radius of gyration Rw ($Rw=(Rg^2)^{1/2}$), which is the square root of the inertial square radius $Rg^2$, to the weight-average molecular weight Mw indicates the degree of branching of each molecule.

A lower Rw/Mw indicates a smaller spread relative to the molecular weight and a higher degree of branching of the molecule. On the other hand, a higher Rw/Mw indicates a greater spread relative to the molecular weight and a more linear molecule.

The weight-average molecular weight Mw of the tetrahydrofuran-soluble matter of a toner according to an embodiment of the present invention measured by SEC-MALLS at 25° C. preferably ranges from 5,000 to 100,000.

A binder resin according to an embodiment of the present invention preferably has a glass transition temperature (Tg) in the range of 45° C. to 70° C. in terms of low-temperature fixability and storage stability. When the binder resin has a Tg of 45° C. or more, this tends to result in improved storage stability. When the binder resin has a Tg of 70° C. or less, this tends to result in improved low-temperature fixability.

A magnetic toner according to an embodiment of the present invention contains a release agent.

Examples of the release agent include, but are not limited to, waxes composed mainly of a fatty acid ester, such as carnauba wax and montanate wax; fatty acid esters from which part or all of their acid components are removed, such as deacidified carnauba wax; methyl ester compounds having a hydroxy group produced by hydrogenation of vegetable oils and fats; saturated fatty acid monoesters, such as stearyl stearate and behenyl behenate; diesters of saturated aliphatic dicarboxylic acids and saturated aliphatic alcohols, such as dibehenyl sebacate, dodecanedioic acid distearyl, and octadecanedioic acid distearyl; diesters of saturated aliphatic diols and saturated fatty acids, such as nonanediol dibehenate and dodecanediol distearate; aliphatic hydrocarbon waxes, such as low-molecular-weight polyethylene, low-molecular-weight polypropylene, microcrystalline waxes, paraffin waxes, and Fischer-Tropsch waxes; oxides of aliphatic hydrocarbon waxes, such as oxidized polyethylene waxes, and block copolymers thereof; vinyl monomer graft waxes, such as styrene or acrylic acid graft aliphatic hydrocarbon waxes; saturated straight-chain fatty acids, such as palmitic acid, stearic acid, and montanic acid; unsaturated fatty acids, such as brassidic acid, eleostearic acid, and parinaric acid; saturated alcohols, such as stearyl alcohol, aralkyl alcohol, behenyl alcohol, carnaubyl alcohol, ceryl alcohol, and myricyl alcohol; polyhydric alcohols, such as sorbitol; fatty acid amides, such as linoleamide, oleamide, and lauramide; saturated fatty acid bisamides, such as methylenebisstearamide, ethylenebiscapramide, ethylenebislauramide, and hexamethylenebisstearamide; unsaturated fatty acid amides, such as ethylenebisoleamide, hexamethylenebisoleamide, N,N'-dioleyladipamide, and N,N'-dioleylsebacamide; aromatic bisamides, such as m-xylenebisstearamide and N,N'-distearylisophthalamide; aliphatic metal salts (generally referred to as metallic soaps), such as calcium stearate, calcium laurate, zinc stearate, and magnesium stearate; and long-chain alkyl alcohols and long-chain alkyl carboxylic acids each having 12 or more carbon atoms.

Among these release agents, monofunctional and bifunctional ester waxes, such as saturated fatty acid monoesters and diesters, and hydrocarbon waxes, such as paraffin waxes and Fischer-Tropsch waxes, can be used.

A release agent can have a maximum endothermic peak in the range of 60° C. to 85° C. in the course of temperature rise in a DSC curve measured using a differential scanning calorimeter. A release agent having a maximum endothermic peak in this temperature range can improve low-temperature fixability and developing stability.

The melting point of the release agent defined by the maximum endothermic peak temperature measured using a differential scanning calorimeter (DSC) in the course of temperature rise preferably ranges from 60° C. to 140° C., more preferably 60° C. to 90° C. A melting point of 60° C. or more results in improved storage stability of a magnetic toner according to an embodiment of the present invention. A melting point of 140° C. or less tends to result in improved low-temperature fixability.

The release agent content preferably ranges from 3 to 30 parts by mass, more preferably 10 to 30 parts by mass, per 100 parts by mass of the binder resin. A release agent content of 3 parts by mass or more tends to result in high releasability from a fixing film and improved low-temperature offset. A release agent content of 30 parts by mass or less tends to result in less magnetic toner deterioration in long-term use and improved image stability.

A magnetic toner according to an embodiment of the present invention can contain a charge control agent. A magnetic toner according to an embodiment of the present invention can be a negatively chargeable toner.

Examples of the charge control agent for negative charging include, but are not limited to, organic metal complex compounds and chelate compounds, such as monoazo metal complex compounds; acetylacetone metal complex compounds; and aromatic hydroxycarboxylic acid and aromatic dicarboxylic acid metal complex compounds.

Specific examples of commercial products include, but are not limited to, Siphon Black TRH, T-77, and T-95 (Hodogaya Chemical Co., Ltd.), and BONTRON (registered trademark) S-34, S-44, S-54, E-84, E-88, and E-89 (Orient Chemical Industries Co., Ltd.).

These charge control agents may be used alone or in combination. The amount of the charge control agent to be used preferably ranges from 0.1 to 10.0 parts by mass, more preferably 0.1 to 5.0 parts by mass, per 100 parts by mass of the binder resin in terms of the amount of electrical charge of the magnetic toner.

Silica fine particles on the magnetic toner surface will be described below.

The silica fine particles are produced by vapor phase oxidation of a silicon halide and can be dry silica or fumed silica. For example, a thermal decomposition and oxidation reaction of silicon tetrachloride gas in oxygen and hydrogen can be utilized as in the following basic reaction formula.

$$SiCl_4+2H_2+O_2 \rightarrow SiO_2+4HCl$$

In this production process, for example, another metal halide, such as aluminum chloride or titanium chloride, can be used in combination with silicon halide to produce fine composite particles composed of silica and another metal oxide. The present invention also embraces such fine composite particles.

The primary particles of silica fine particles in an embodiment of the present invention preferably have a number-average particle diameter (D1) in the range of 5 to 20 nm, more preferably 7 to 15 nm.

When the silica fine particles have a particle diameter in this range, it is easy to control the coverage X1 and the diffusion index.

In an embodiment of the present invention, the number-average particle diameter (D1) of primary particles of silica fine particles can be measured by observing the silica fine particles using a scanning electron microscope before the external addition of the silica fine particles to toner or by observing the toner surface after the external addition of the silica fine particles to the toner. The number-average particle diameter (D1) of primary particles is calculated by averaging the particle diameters of at least 300 silica fine particles.

The silica fine particles produced by the gas phase oxidation of the silicon halide can be silica fine particles subjected to hydrophobic surface treatment. The treated silica fine particles preferably have a hydrophobicity in the range of 30 to 80 as measured in a methanol titration test.

The hydrophobic treatment method may be a method for chemically treating silica fine particles with an organosilicon compound and/or silicone oil, which can react with or can be physically adsorbed on the silica fine particles. Silica fine particles produced by vapor phase oxidation of a silicon halide can be chemically treated with an organosilicon compound.

Examples of the organosilicon compound include, but are not limited to, hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane that has 2 to 12 siloxane units per molecule and has one hydroxy group on each Si of terminal siloxane units. These organosilicon compounds may be used alone or in combination.

Silane coupling agents having a nitrogen atom can also be used alone or in combination, for example, aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopropyldimethoxysilane, dibutylaminopropylmonomethoxysilane, dimethylaminophenyltriethoxysilane, trimethoxysilyl-γ-propylphenylamine, and trimethoxysilyl-γ-propylbenzylamine. The silane coupling agent can be hexamethyldisilazane (HMDS).

The silicone oil preferably has a viscosity in the range of 0.5 to 10,000 $mm^2/S$, more preferably 1 to 1000 $mm^2/S$, still more preferably 10 to 200 $mm^2/S$, at 25° C. Specific examples of the silicone oil include, but are not limited to, dimethyl silicone oil, methylphenyl silicone oil, α-methylstyrene-modified silicone oil, chlorophenyl silicone oil, and fluorine-modified silicone oil.

Examples of the silicone oil treatment method include, but are not limited to, a method for directly mixing silica fine particles treated with a silane coupling agent and a silicone oil in a mixer, such as a Henschel mixer, a method for spraying silica fine particles with a silicone oil, and a method for dissolving or dispersing a silicone oil in a solvent, mixing the solution or dispersion liquid and silica fine particles, and removing the solvent.

Silica of silica fine particles treated with a silicone oil can preferably be heated to 200° C. or more (more preferably 250° C. or more) in an inert gas after the silicone oil treatment in order to stabilize the surface coating.

The amount of silicone oil preferably ranges from 1 to 40 parts by mass, more preferably 3 to 35 parts by mass, per 100 parts by mass of silica fine particles in order to improve hydrophobic properties.

The silica fine particles before hydrophobic treatment (silica raw material) preferably have a specific surface area in the range of 20 to 350 $m^2/g$, more preferably 25 to 300 $m^2/g$, in order to impart high flowability to the toner. The specific surface area is measured by using the BET method utilizing nitrogen adsorption.

The measurement of the specific surface area using the BET method utilizing nitrogen adsorption conforms to JIS Z 8830 (2001). The measuring apparatus is "Automatic Surface Area and Porosimetry Analyzer TriStar 3000 (manufactured by Shimadzu Corporation)", which employs a constant-volume gas adsorption method.

Silica fine particles for use in an embodiment of the present invention preferably have an apparent density in the range of 15 to 50 g/L, more preferably 20 to 40 g/L. The apparent density of silica fine particles in this range indicates that the silica fine particles are not closely packed and include much air therebetween and that the apparent density is very low. Thus, toner particles are also not closely packed, and the adhesion strength between the toner particles tends to be decreased.

The apparent density of silica fine particles can be controlled in this range by controlling the particle diameter of the silica raw material of the silica fine particles, by controlling the intensity of crushing before, after, and/or during the hydrophobic treatment, or by changing the amount of silicone oil. A decrease in the particle diameter of the silica raw material results in an increased BET specific surface area of the resulting silica fine particles, an increased amount of air between the silica fine particles, and a decreased apparent density. Crushing can break relatively large aggregates contained in silica fine particles into relatively small secondary particles and thereby decrease the apparent density.

The amount of silica fine particles to be added preferably ranges from 0.3 to 2.0 parts by mass per 100 parts by mass of magnetic toner particles, which have a magnetic material content in the range of 35% to 50% by mass. When the amount of silica fine particles to be added is in this range, it is easy to appropriately control the coverage and diffusion index.

In addition to silica fine particles, a magnetic toner according to an embodiment of the present invention may contain other particles having a number-average primary particle diameter (D1) in the range of 80 nm to 3 μm. Examples of the other particles include, but are not limited to, lubricants, such as a fluoropolymer powder, a zinc stearate powder, and a poly(vinylidene fluoride) powder; abrasives, such as a cerium oxide powder, a silicon carbide powder, and a strontium titanate powder; and spacer particles, such as silica. These other particles may be used in a small amount so as not to compromise the advantages of the present invention.

The silica fine particles can be mixed with the magnetic material in a known external addition and mixing treatment apparatus. The coverage X1 and diffusion index can be easily controlled by using an apparatus as illustrated in FIG. 3.

Figure 3:
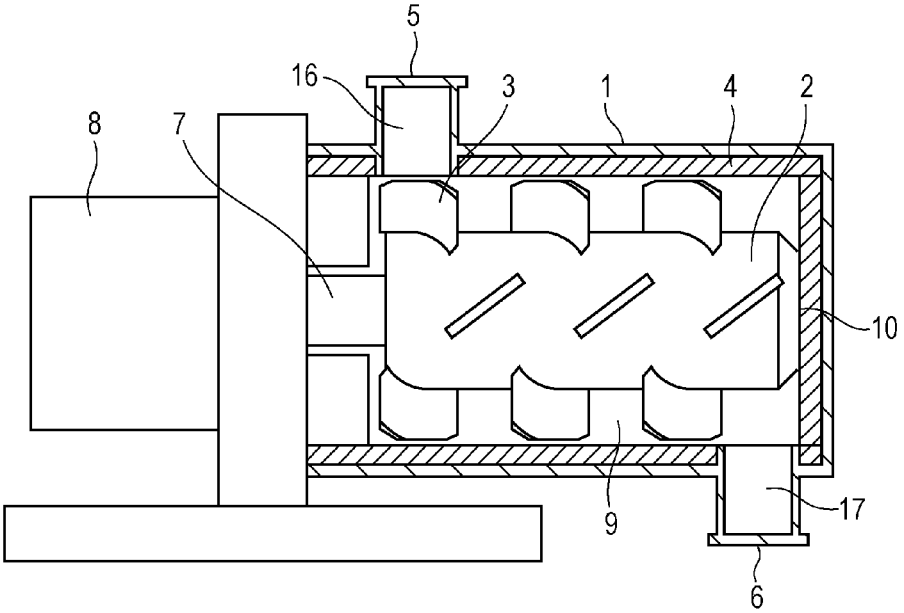
FIG. 3 is a schematic view of a mixing treatment apparatus that can be used for external addition and mixing of fine inorganic particles.

FIG. 3 is a schematic view of a mixing treatment apparatus that can be used for external addition and mixing of fine inorganic particles used in an embodiment of the present invention.

In this mixing treatment apparatus, toner particles and silica fine particles are subjected to shear stress in a narrow clearance portion. Thus, while secondary particles of the silica fine particles are broken into primary particles, the silica fine particles can adhere to the toner particle surface.

Furthermore, as described below, toner particles and silica fine particles can easily rotate in the axial direction of a rotating body and can be well mixed before the silica fine particles adhere to the toner particle surface. Thus, the coverage X1 and diffusion index can be easily controlled in the preferred ranges of an embodiment of the present invention.

Figure 4:
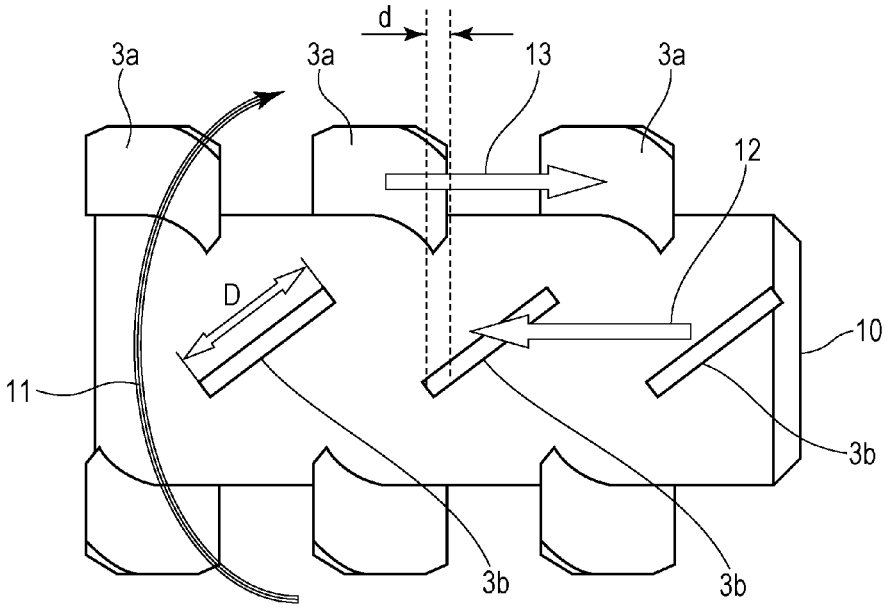
FIG. 4 is a schematic view of a stirring member in the mixing treatment apparatus.

FIG. 4 is a schematic view of a stirring member in the mixing apparatus.

The external addition and mixing process for silica fine particles will be described below with reference to FIGS. 3 and 4.

An external addition and mixing treatment apparatus for silica fine particles includes a rotating body 2, which has a plurality of stirring members 3 on the surface thereof, a drive unit 8 for rotating the rotating body 2 around a central axis 7, and a main body casing 1 spaced apart from the stirring members 3.

It is important to maintain a small constant clearance between an inner-area of the main body casing 1 and the stirring members 3 so that shear stress is uniformly applied to toner particles in the clearance to brake secondary particles of silica fine particles into primary particles, thereby facilitating the adhesion of the silica fine particles to the toner particle surface.

In the apparatus, the diameter of the inner-area of the main body casing 1 is not more than twice the diameter of the outer-area of the rotating body 2. In FIG. 3, the diameter of the inner-area of the main body casing 1 is 1.7 times the diameter of the outer-area of the rotating body 2 (the diameter of the trunk of the rotating body 2 excluding the stirring members 3). When the diameter of the inner-area of the main body casing 1 is not more than twice the diameter of the outer-area of the rotating body 2, the treatment space in which shear stress is applied to toner particles is appropriately limited, and secondary particles of the silica fine particles can be subjected to sufficient impact force.

It is important to adjust the clearance to the size of the main body casing 1. It is important that the clearance ranges from approximately 1% to 5% of the diameter of the inner-area of the main body casing 1 in order to apply sufficient shear stress to the silica fine particles. More specifically, when the diameter of the inner-area of the main body casing 1 is approximately 130 mm, the clearance may range from approximately 2 to 5 mm. When the diameter of the inner-area of the main body casing 1 is approximately 800 mm, the clearance may range from approximately 10 to 30 mm.

In an external addition and mixing process for silica fine particles in a mixing treatment apparatus according to an embodiment of the present invention, the drive unit 8 rotates the rotating body 2 to mix toner particles and silica fine particles in the mixing treatment apparatus, thereby allowing the silica fine particles to adhere to the toner particle surface.

As illustrated in FIG. 4, at least part of the stirring members 3 act as conveying stirring members 3*a* for conveying toner particles and silica fine particles in one axial direction of the rotating body 2 as the rotating body 2 rotates. At least part of the stirring members 3 act as return stirring members 3*b* for returning toner particles and silica fine particles in the other axial direction of the rotating body 2 as the rotating body 2 rotates. As illustrated in FIG. 3, in the case where a raw material inlet 5 and a product outlet 6 are disposed at opposite ends of the main body casing 1, the direction from the raw material inlet 5 to the product outlet 6 (rightward in FIG. 3) is referred to as a "forward direction".

As illustrated in FIG. 4, the surfaces of the conveying stirring members 3*a* are inclined such that toner particles are conveyed in the forward direction (13). On the other hand, the surfaces of the return stirring members 3*b* are inclined such that toner particles and silica fine particles are conveyed in a backward direction (12). Thus, while toner particles and silica fine particles are alternately conveyed in the "forward direction" (13) and the "backward direction" (12), the silica fine particles adhere to the toner particle surface. Each of the stirring members 3*a* and 3*b* arranged at intervals in the circumferential direction of the rotating body 2 forms a set of stirring members. In the embodiment illustrated in FIG. 4, two of the stirring members 3*a* or 3*b* on the rotating body 2 arranged at intervals of 180 degrees in the circumferential direction form one set. Alternatively, three, four, or more of the stirring members 3*a* or 3*b* arranged at intervals of 120, 90, and the corresponding degrees may form one set.

In the embodiment illustrated in FIG. 4, twelve stirring members 3*a* and 3*b* are spaced at regular intervals.

In FIG. 4, D denotes the width of the stirring members 3*a* and 3*b*, and d denotes the overlap between the stirring members 3*a* and the stirring members 3*b*. In order to efficiently convey toner particles and silica fine particles in the forward direction and the backward direction, the width D preferably ranges from approximately 20% to 30% of the length of the rotating body 2 illustrated in FIG. 4. In FIG. 4, the width D is 23% of the length of the rotating body 2. The stirring members 3*a* and 3*b* can have the overlap d when viewed in the transverse direction. This allows secondary particles of silica fine particles to be efficiently subjected to shear stress. The overlap d preferably ranges from 10% to 30% of the width D in terms of the application of shear stress.

The shape of the stirring members 3*a* and 3*b* is not limited to the shape illustrated in FIG. 4 and may be any shape that allows toner particles to be conveyed in the forward and backward directions and the clearance to be maintained. For example, the stirring members 3*a* and 3*b* may have a curved surface or may have a paddle structure in which the front edges of the stirring members 3*a* and 3*b* are fixed to the rotating body 2 through a rod-like arm.

The present invention will be further described below with reference to the schematic views of the apparatus illustrated in FIGS. 3 and 4.

The apparatus illustrated in FIG. 3 includes the rotating body 2, which has the stirring members 3 on the surface thereof, the drive unit 8 for rotating the rotating body 2, and the main body casing 1 spaced apart from the stirring members 3. The apparatus further includes a jacket 4 disposed inside of the main body casing 1 and on a side surface 10 of an end portion of the rotating body 2. A cooling or heating medium can flow through the jacket 4.

The apparatus illustrated in FIG. 3 further includes the raw material inlet 5 and the product outlet 6. The raw material inlet 5 is disposed on an upper portion of the main body casing 1 and is used to introduce toner particles and silica fine particles. The product outlet 6 is disposed on a lower portion of the main body casing 1 and is used to discharge treated toner from the main body casing 1.

The apparatus illustrated in FIG. 3 further includes a raw material inlet inner piece 16 in the raw material inlet 5 and a product outlet inner piece 17 in the product outlet 6.

In an embodiment of the present invention, first, the raw material inlet inner piece 16 is removed from the raw material inlet 5, and toner particles are charged into a treatment space 9 through the raw material inlet 5. Silica fine particles are then charged into the treatment space 9 through the raw material inlet 5, and the raw material inlet inner piece 16 is inserted into the raw material inlet 5. The rotating body 2 is then rotated by the drive unit 8 (an arrow 11 denotes the rotation direction). The coating treatment materials are stirred using the stirring members 3 disposed on the rotating body 2, thereby allowing the silica fine particles to adhere to the toner particles.

With respect to the order of charging, the silica fine particles may first be charged through the raw material inlet 5, and then the toner particles may be charged through the raw material inlet 5. The toner particles and the silica fine particles may be mixed in advance in a mixer, such as a Henschel mixer, and the mixture is then charged through the raw material inlet 5 of the apparatus illustrated in FIG. 3.

In an embodiment of the present invention, after toner particles and silica fine particles are mixed, other silica fine particles can be added to the mixture (two-stage mixing). The two-stage mixing can facilitate the control of embedding of the external additive. More specifically, the power of the drive unit 8 in the external addition and mixing treatment conditions is preferably controlled in the range of 0.2 to 2.0 W/g in order to achieve the coverage X1 and diffusion index specified by an embodiment of the present invention. More preferably, the power of the drive unit 8 is controlled in the range of 0.6 to 1.6 W/g. A power of less than 0.2 W/g tends to result in a low coverage X1 and an excessively low diffusion index. On the other hand, a power of more than 2.0 W/g tends to result in a high diffusion index but excessive embedding of silica fine particles.

The treatment time is not particularly limited and preferably ranges from 3 to 10 minutes. A treatment time of less than 3 minutes tends to result in a low coverage X1 and diffusion index.

The number of rotation of the stirring members during external addition and mixing is not particularly limited. When the treatment space 9 of the apparatus illustrated in FIG. 3 has a volume of $2.0\times10^{-3}$ $m^3$, and the stirring members 3 have a shape illustrated in FIG. 4, the number of rotation of the stirring members preferably ranges from 800 to 3000 rpm. When the number of rotation of the stirring members ranges from 800 to 3000 rpm, it is easy to achieve the coverage X1 and diffusion index specified by an embodiment of the present invention.

In the treatment method according to an embodiment of the present invention, a premixing process may be performed before the external addition and mixing treatment operation. The premixing process allows silica fine particles to be highly uniformly dispersed on the toner particle surface and tends to result in a high coverage X1 and diffusion index. More specifically, in the premixing treatment conditions, the power of the drive unit 8 preferably ranges from 0.06 to 0.20 W/g, and the treatment time preferably ranges from 0.5 to 1.5 minutes. In the premixing treatment conditions, a load power of less than 0.06 W/g or a treatment time of less than 0.5 minutes tends to result in insufficient and nonuniform premixing. On the other hand, in the premixing treatment conditions, a load power of more than 0.20 W/g or a treatment time of more than 1.5 minutes sometimes results in adhering of silica fine particles to the toner particle surface before sufficient and uniform premixing.

When the treatment space 9 of the apparatus illustrated in FIG. 3 has a volume of $2.0\times10^{-3}$ $m^3$, and the stirring members 3 have a shape illustrated in FIG. 4, the number of rotation of the stirring members in the premixing treatment preferably ranges from 50 to 500 rpm. When the number of rotation of the stirring members ranges from 50 to 500 rpm, it is easy to achieve the coverage X1 and diffusion index specified by an embodiment of the present invention.

After the completion of the external addition and mixing treatment, the product outlet inner piece 17 is removed from the product outlet 6, and the rotating body 2 is rotated by the drive unit 8 to discharge toner from the product outlet 6. If necessary, coarse particles are removed from the toner using a shifter, such as a circular vibrating shifter.

From the perspective of the balance between developability and fixability, a magnetic toner according to an embodiment of the present invention preferably has a weight-average particle diameter (D4) in the range of 5.0 to 10.0 μm, more preferably 6.0 to 9.0 μm.

In an embodiment of the present invention, the toner particles have an average circularity of 0.960 or more, more preferably 0.970 or more. When the toner particles have an average circularity of 0.960 or more, the toner has a spherical or substantially spherical shape, and the toner on an unfixed image tends to form a state close to the closest packing. Furthermore, this tends to result in high flowability and uniform triboelectric chargeability. Thus, the toner can retain high developability even in the latter part of long-term use. Furthermore, it is easy to control the coverage X1 and diffusion index of toner particles having high average circularity within the scope of the present invention in the external addition treatment of fine inorganic particles described below.

A method for manufacturing a toner according to an embodiment of the present invention will be described below. However, the present invention is not limited to this method.

Magnetic toner particles contained in a toner according to an embodiment of the present invention may be manufactured by using a pulverization process. However, such toner particles are generally amorphous and rarely have high thermal conductivity of the present invention. This is probably because such toner particles rarely have the mag-shell structure, and the magnetic material rarely forms a network structure. Thus, mechanical, thermal, or another special treatment is required to achieve the thermal conductivity of the present invention. Such a treatment reduces productivity.

Thus, a toner according to an embodiment of the present invention can be manufactured in an aqueous medium, for example, by using a dispersion polymerization method, an association aggregation method, a dissolution suspension method, or a suspension polymerization method. In particular, a toner manufactured by using a suspension polymerization method has physical properties suitable for the present invention.

In a suspension polymerization method, first, a magnetic material (and, if necessary, a polymerization initiator, a crosslinking agent, a charge control agent, and other additive agents) is uniformly dispersed in a polymerizable monomer to produce a polymerizable monomer composition. The polymerizable monomer composition is then dispersed using a mixer in a continuous phase (for example, an aqueous phase) containing a dispersion stabilizer. A polymerization initiator is used to initiate a polymerization reaction, thereby manufacturing magnetic toner particles having the desired particle diameter. The toner manufactured by using the suspension polymerization method (hereinafter also referred to as a "polymerized toner") includes substantially spherical toner particles and complies with the physical property requirements suitable for the present invention.

Examples of the polymerizable monomer include, but are not limited to:

styrene monomers, such as styrene, o-methylstyrene, m-methylstyrene, p-methylstyrene, p-methoxystyrene, and p-ethylstyrene; acrylates, such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylates, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and other monomers, such as acrylonitrile, methacrylonitrile, and acrylamide. These monomers may be used alone or in combination. Among these monomers, styrene or a styrene derivative can be used alone or in combination with another monomer to control the toner structure and improve the developing characteristics and endurance of the toner. In particular, styrene and an alkyl acrylate or styrene and an alkyl methacrylate can be used as main components.

A polymerization initiator for use in the manufacture of a toner according to an embodiment of the present invention using a polymerization method preferably has a half-life in the range of 0.5 to 30 hours in the polymerization reaction. 0.5 to 20 parts by mass of a polymerization initiator per 100 parts by mass of the polymerizable monomer can be used in the polymerization reaction to produce a polymer having a maximum molecular weight in the range of 5,000 to 50,000, which can impart appropriate strength and melt properties to the toner.

The polymerization reaction temperature can be higher by 15° C. to 35° C. than the 10-hour half-life temperature. This can promote the polymerization reaction and suppress excessive branching or cross-linking of the binder resin.

Specific examples of the polymerization initiator include, but are not limited to, azo and diazo polymerization initiators, such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide polymerization initiators, such as benzoyl peroxide, methyl ethyl ketone peroxide, diisopropyl peroxydicarbonate, cumene hydroperoxide, 2,4-dichlorobenzoyl peroxide, lauroyl peroxide, t-butyl peroxy 2-ethylhexanoate, t-butyl peroxypivalate, di(2-ethylhexyl) peroxydicarbonate, and di(sec-butyl) peroxydicarbonate. Among these, peroxydicarbonates, such as di(2-ethylhexyl) peroxydicarbonate and di(sec-butyl) peroxydicarbonate, can be used to produce a binder resin having a low molecular weight and a linear molecular structure, as described above.

In the production of a toner according to an embodiment of the present invention using a polymerization method, a crosslinking agent may be used. The amount of crosslinking agent preferably ranges from 0.001 to 15 parts by mass per 100 parts by mass of the polymerizable monomer.

The crosslinking agent is generally a compound having two or more polymerizable double bonds. Examples of such a compound include, but are not limited to, aromatic divinyl compounds, such as divinylbenzene and divinylnaphthalene; carboxylate esters having two double bonds, such as ethylene glycol diacrylate, ethylene glycol dimethacrylate, and 1,3-butanediol dimethacrylate; divinyl compounds, such as divinyl aniline, divinyl ether, divinyl sulfide, and divinyl sulfone; and compounds having three or more vinyl groups. These crosslinking agents may be used alone or in combination.

The polymerizable monomer composition can contain a polarity resin. In a suspension polymerization method, since magnetic toner particles are manufactured in an aqueous medium, a polarity resin can be used to form a polarity resin layer on the surfaces of magnetic toner particles, thus forming magnetic toner particles having a core/shell structure.

The core/shell structure can increase the degree of freedom of core designing and improve low-temperature offset. For example, the glass transition temperature of the core can be lowered by increasing the glass transition temperature of the shell. When the shell has a shield effect, the core can have a low molecular weight or contain a large amount of release agent, which tends to result in improved low-temperature offset. Active formation of the core/shell structure can facilitate the formation of the mag-shell structure. Toner particles having such a structure can have high thermal conductivity.

Examples of the polarity resin to form the shell layer include, but are not limited to, homopolymers of styrene and its substitution products, such as polystyrene and polyvinyltoluene; styrene copolymers, such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleate copolymer; poly(methyl methacrylate), poly(butyl methacrylate), poly(vinyl acetate), polyethylene, polypropylene, poly(vinyl butyral), silicone resin, polyester resin, styrene-polyester copolymer, polyacrylate-polyester copolymer, polymethacrylate-polyester copolymer, polyamide resin, epoxy resin, poly(acrylic acid) resin, terpene resin, and phenolic resin. These polarity resins may be used alone or in combination. These polymers may have a functional group, such as an amino group, carboxy group, hydroxy group, sulfo group, glycidyl group, and/or nitrile group. Among these resins, as described above, polyester resin may be used.

The polyester resin may be a saturated polyester resin, an unsaturated polyester resin, or both of them.

The polyester resin for use in an embodiment of the present invention may be composed of an alcohol component and an acid component. Examples of the alcohol component and the acid component are described below.

Examples of the alcohol component include, but are not limited to, divalent alcohol components, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexanedimethanol, butenediol, octenediol, cyclohexenedimethanol, hydrogenated bisphenol A, bisphenol derivatives represented by the formula (I),

[Chem. 1]

(I)

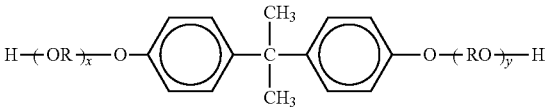

wherein R denotes an ethylene or propylene group, x and y each independently denotes an integer of 1 or more, and the average value of x+y ranges from 2 to 10, hydrogenated products of the bisphenol derivatives represented by the formula (I), diols represented by the formula (II), and

[Chem. 2]

(II)

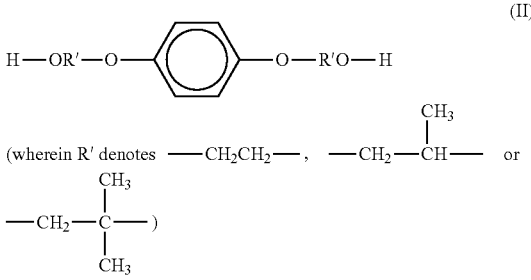

hydrogenated products of the diols represented by the formula (II).

The divalent alcohol component can be an alkylene oxide adduct of bisphenol A, which has satisfactory charging characteristics and environmental stability and a good balance of other electrophotographic characteristics. The average number of moles of the alkylene oxide preferably ranges from 2 to 10 in terms of fixability and the endurance of toner.

Examples of the acid component include, but are not limited to, divalent acid components, including benzene dicarboxylic acids and anhydrides thereof, such as phthalic acid, terephthalic acid, isophthalic acid, and phthalic anhydride; alkyl dicarboxylic acids and anhydrides thereof, such as succinic acid, adipic acid, sebacic acid, and azelaic acid; succinic acid substituted by an alkyl or alkenyl group having 6 to 18 carbon atoms, and anhydrides thereof; and unsaturated dicarboxylic acids and anhydrides thereof, such as fumaric acid, maleic acid, citraconic acid, and itaconic acid.

Examples of the alcohol component include, but are not limited to, trivalent or more alcohol components, such as glycerin, pentaerythritol, sorbitol, sorbitan, and oxyalkylene ethers of novolak phenolic resin. Examples of the acid component include, but are not limited to, trivalent or more acid components, such as trimellitic acid, pyromellitic acid, 1,2,3,4-butanetetracarboxylic acid, benzophenonetetracarboxylic acid, and anhydrides thereof.

In an embodiment of the present invention, the alcohol component can constitute 45% to 55% by mole of the polyester resin, and the acid component can constitute 55% to 45% by mole of the polyester resin.

The polyester resin in an embodiment of the present invention can be produced by using a catalyst, such as a tin catalyst, antimony catalyst, or titanium catalyst. The polyester resin in an embodiment of the present invention can be produced by using a titanium catalyst.

The polarity resin to form the shell preferably has a number-average molecular weight in the range of 2500 to 25,000 in terms of developability, blocking resistance, endurance, and low-temperature fixability. The number-average molecular weight can be measured by GPC.

The polarity resin to form the shell preferably has an acid value in the range of 6 to 10 mgKOH/g. An acid value of 6 mgKOH/g or more tends to result in the formation of a uniform shell. An acid value of 10 mgKOH/g or less results in a small interaction between the magnetic material and the shell layer, suppressed cohesiveness of the magnetic material, and improved thermal conductivity.

The amount of the polarity resin to form the shell layer preferably ranges from 2 to 10 parts by mass per 100 parts by mass of the binder resin in order to produce a sufficient effect of the shell layer.

The aqueous medium in which the polymerizable monomer composition is to be dispersed contains a dispersion stabilizer. The dispersion stabilizer may be a known surfactant, organic dispersant, or inorganic dispersant. In particular, because of its dispersion stability due to steric hindrance, an inorganic dispersant is stable in a wide reaction temperature range, is easy to wash away, and has little adverse effects on toner. Examples of the inorganic dispersant include, but are not limited to, polyvalent metal phosphates, such as tricalcium phosphate, magnesium phosphate, aluminum phosphate, zinc phosphate, and hydroxyapatite; carbonates, such as calcium carbonate and magnesium carbonate; inorganic salts, such as calcium metasilicate, calcium sulfate, and barium sulfate; and inorganic compounds, such as calcium hydroxide, magnesium hydroxide, and aluminum hydroxide.

The amount of the inorganic dispersant preferably ranges from 0.2 to 20 parts by mass per 100 parts by mass of the polymerizable monomer. These dispersion stabilizers may be used alone or in combination. The dispersion stabilizer may be used in combination with 0.001 to 0.1 parts by mass of a surfactant. The inorganic dispersant may be directly used or may be used as particles in an aqueous medium in order to produce finer particles. In the case of tricalcium phosphate, aqueous sodium phosphate and aqueous calcium chloride are mixed while stirring at high speed to form water-insoluble calcium phosphate, which can be more uniformly and finely dispersed. In this case, water-soluble sodium chloride is produced as a by-product. Such a water-soluble salt in an aqueous medium suppresses the dissolution of a polymerizable monomer into water and fortunately suppresses the formation of ultrafine toner resulting from emulsion polymerization.

Examples of the surfactant include, but are not limited to, sodium dodecylbenzenesulfonate, sodium tetradecyl sulfate, sodium pentadecyl sulfate, sodium octyl sulfate, sodium oleate, sodium laurate, sodium stearate, and potassium stearate.

In the polymerization process of the polymerizable monomer, the polymerization temperature is 40° C. or more, generally in the range of 50° C. to 90° C. In the polymerization in this temperature range, a release agent to be included in the magnetic toner is precipitated by phase separation. This makes the inclusion more complete.

In the subsequent cooling process, the product is cooled from a reaction temperature in the range of approximately 50° C. to 90° C. to complete the polymerization reaction process. Cooling can be slowly performed while maintaining the compatibility between the release agent and the binder resin.

After the completion of the polymerization of the polymerizable monomer, the resulting polymer particles are filtered, washed, and dried by using known methods, thus forming toner particles. The toner particles can be mixed with silica fine particles as required. The silica fine particles adhere to the toner particle surface, and a toner according to an embodiment of the present invention is completed. The manufacturing process may include a classification process (before the mixing of the inorganic fine powder) to remove coarse particles and fine particles from the toner particles.

An image-forming apparatus that can suitably use a toner according to an embodiment of the present invention will be more specifically described with reference to FIG. 1. In FIG. 1, an image-forming apparatus includes an electrostatic latent image bearing member 100 (hereinafter also referred to as a photosensitive member), as well as a charging member (charging roller) 117, a developing unit 140, a transfer member (transfer charging roller) 114, a residual toner container 116, a fixing unit 126, and a pickup roller 124 disposed around the electrostatic latent image bearing member 100. The developing unit 140 includes a toner carrier 102, a developing blade 103, and a stirring member 141. The electrostatic latent image bearing member 100 is charged by the charging roller 117. The electrostatic latent image bearing member 100 is exposed to a laser beam 123 emitted from a laser generator 121, thereby forming an electrostatic latent image corresponding to the target image. The electrostatic latent image on the electrostatic latent image bearing member 100 is developed using a monocomponent toner in the developing unit 140, thereby forming a toner image. The toner image is transferred to a transfer material using the transfer roller 114, which is disposed opposite the electrostatic latent image bearing member with the transfer material interposed therebetween. The transfer material to which the toner image is transferred is conveyed by a conveying belt 125 to the fixing unit 126, and the toner image is fixed to the transfer material. The residual toner is scraped from the electrostatic latent image bearing member using a cleaning blade and is stored in the residual toner container 116.

Methods for measuring physical properties related to the present invention will be described below.

<Method for Measuring Thermal Conductivity>

(1) Preparation of Sample

Two cylindrical samples each having a diameter of 25 mm and a height of 6 mm are prepared by compressing approximately 5 g of toner (the mass depends on the specific gravity of the sample) using a tablet molding machine at 25° C. and at approximately 20 MPa for 60 seconds.

(2) Measurement of Thermal Conductivity

Measuring apparatus: Hot disk thermal constants analyzer TPS 2500S

Sample holder: Sample holder for room temperature

Sensor: Standard accessory (RTK) sensor

Software: Hot disk analysis 7

A sample is placed on a mounting table in a sample holder for room temperature. The height of the table is adjusted such that the top of the sample is at the level of the sensor.

A second sample is placed on the sensor, and a piece of accessory metal is placed on the second sample. A pressure is applied to the accessory metal using a screw disposed on top of the sensor. The pressure is adjusted to be 30 cN·m using a torque wrench. It is confirmed that the centers of the second sample and the sensor are just below the screw.

The Hot disk analysis is started up, and "Bulk (Type I)" is chosen as the experiment type.

Input items are as follows:

Available Probing Depth: 6 mm

Measurement time: 40 s

Heating Power: 60 mW

Sample Temperature: 23° C.

TCR: 0.004679 $K^{-1}$

Sensor Type: Disk

Sensor Material Type: Kapton

Sensor Design: 5465

Sensor Radius: 3.189 mm

After the input, the measurement is started. After the completion of the measurement, the "Calculate" button is chosen, "Start Point: 10" and "End Point: 200" are input, the "Standard Analysis" button is chosen, and "Thermal Conductivity" [W/mK] is calculated.

<Method for Determining Number of Silica Fine Particles>

(1) Measurement of Silica Fine Particle Content of Toner (Standard Addition Method)

3 g of toner in an aluminum ring having a diameter of 30 mm is pressed at 10 tons to manufacture a pellet. The intensity of silicon (Si) is determined by wavelength dispersive X-ray fluorescence spectroscopy (XRF) (Si intensity-1). The measurement conditions are optimized for the XRF apparatus.

The intensity measurements are performed under the same conditions. The toner is mixed with silica fine particles having a number-average primary particle diameter of 12 nm in a coffee mill. The amount of the silica fine particles is 1.0% by mass of the amount of the toner. The mixture is pelletized in the same manner as described above, and the Si intensity is determined in the same manner as described above (Si intensity-2). The Si intensity is determined in the same manner for samples having a silica fine particle content of 2.0% by mass or 3.0% by mass of the toner (Si intensity-3, Si intensity-4). The Si intensities-1 to 4 are used to calculate the silica content (% by mass) of the toner by using the standard addition method.

(2) Separation of Silica Fine Particles from Toner

For toners containing a magnetic material, the amount of silica fine particles is determined through the following process.

5 g of toner is weighed in a 200-mL polymer cup having a lid using a precision balance. 100 mL of methanol is added to the toner. The toner is dispersed using an ultrasonic homogenizer for 5 minutes. While a neodymium magnet attracts the toner, the supernatant liquid is discarded. After dispersion of the toner in methanol and discarding of the supernatant are repeated three times, the toner is gently mixed with 100 mL of 10% NaOH and a few drops of "Contaminon N" (a 10% by mass aqueous solution of a neutral detergent for cleaning precise measuring instruments composed of a nonionic surfactant, an anionic surfactant, and an organic builder, pH 7, manufactured by Wako Pure Chemical Industries, Ltd.), and is left still for 24 hours. While a neodymium magnet attracts the toner, the supernatant liquid is discarded. The toner is washed with distilled water so that no NaOH remains. Collected particles are thoroughly dried in a vacuum dryer to form particles A. The externally added silica fine particles are dissolved and removed through these operations.

(3) Measurement of Intensity of Si in Particles A 3 g of the particles A in an aluminum ring having a diameter of 30 mm is pressed at 10 tons to manufacture a pellet. The Si intensity is determined by wavelength dispersive X-ray fluorescence spectroscopy (XRF) (Si intensity-5). The Si intensity-5 and the Si intensities-1 to 4 used in the determination of the silica content of the toner are used to calculate the silica content (% by mass) of the particles A.

(4) Separation of Magnetic Material from Toner 5 g of the particles A are well mixed with 100 mL of tetrahydrofuran and are subjected to ultrasonic dispersion for 10 minutes. While a magnet attracts the magnetic particles, the supernatant liquid is discarded. This operation is repeated five times to form particles B. The organic components, such as a resin, other than the magnetic material can be substantially removed through these operations. However, tetrahydrofuran-insoluble matter may remain in the resin. Thus, the particles B may be heated to 800° C. to burn the residual organic components. Particles C formed by heating can be considered to be a magnetic material contained in toner.

The mass of the particles C can be considered to be the magnetic material content W (% by mass) of the magnetic toner. In order to compensate for the increase in mass of the magnetic material due to oxidation, the mass of the particles C is multiplied by 0.9666 ($Fe_2O_3 \rightarrow Fe_3O_4$).

The amount of externally added silica fine particles is calculated from these measurements using the following equation:

Amount of externally added silica fine particles $$(\%\text{ by mass}) = \text{Silica content of toner } (\%\text{ by mass}) - \text{Silica content of particles } A (\%\text{ by mass})$$

<Method for Measuring Coverage X1>

The coverage X1 of the toner surface by silica fine particles is calculated as described below.

First, the toner surface is subjected to the elementary analysis using the following apparatus under the following conditions.

Measuring apparatus: Quantum 2000 (trade name, manufactured by ULVAC-PHI, Inc.)
X-ray source: Monochrome Al Kα
X-ray setting: 100 μmϕ (25 W(15 KV))
Photoelectron take-off angle: 45 degrees
Neutralization condition: Combination of flood gun and ion gun
Area of analysis: 300×200 μm
Pass Energy: 58.70 eV
Step size: 1.25 eV
Analysis software: Multipack (PHI)

The quantitative value for Si atom is calculated from C1c (B.E. 280 to 295 eV), O1s (B.E. 525 to 540 eV), and Si2p (B.E. 95 to 113 eV) peaks. The quantitative value for Si is referred to as Y1.

In the same manner as in the elementary analysis of the toner surface described above, silica fine particles are subjected to the elementary analysis. The resulting quantitative value for the silica fine particles is referred to as Y2.

In an embodiment of the present invention, the coverage X1 of the toner surface by the silica fine particles is defined by the following equation using Y1 and Y2.

$$\text{Coverage } X1 (\%\text{ by area}) = Y1/Y2 \times 100$$

In order to improve the precision of the measurement, Y1 and Y2 can be measured twice or more.

In the case where silica fine particles to be externally added are available, the quantitative value Y2 may be measured using the silica fine particles.

In the case where silica fine particles separated from the toner surface are used as a sample, the silica fine particles are separated from the toner particles through the following procedures.

1) Magnetic Toner

First, a dispersion medium is prepared by adding 6 mL of Contaminon N (a 10% by mass aqueous solution of a neutral detergent for cleaning precise measuring instruments composed of a nonionic surfactant, an anionic surfactant, and an organic builder, pH 7, manufactured by Wako Pure Chemical Industries, Ltd.) to 100 mL of ion-exchanged water. 5 g of toner is added to the dispersion medium and is dispersed using an ultrasonic homogenizer for 5 minutes. The dispersion liquid is then shaken using a "KM Shaker" (model: V.SX) manufactured by Iwaki Co. Ltd. at 350 cycles/min for 20 minutes. While a neodymium magnet attracts toner particles, the supernatant is collected. The supernatant is dried to collect silica fine particles. If the silica fine particles are insufficient, the operation is repeated.

In this method, when an external additive other than the silica fine particles has been added, the external additive is also collected. In this case, the external additive can be removed from the silica fine particles by centrifugation, for example.

2) Non-Magnetic Toner 160 g of sucrose (Kishida Chemical Co., Ltd.) is dissolved in 100 mL of ion-exchanged water in a vessel in hot water to prepare a concentrated sucrose solution. A centrifugation tube is filled with 31 g of the concentrated sucrose solution and 6 mL of Contaminon N to prepare a dispersion liquid. 1 g of toner is added to the dispersion liquid. Lumps of toner are loosened using a spatula.

The centrifugation tube is shaken using the shaker at 350 cycles/min for 20 minutes. After shaking, the solution is transferred to a glass tube for a swing rotor (50 mL) and is centrifuged in a centrifugal separator at 3500 rpm for 30 min. In the glass tube after centrifugation, the toner is present in the top layer, and the silica fine particles are present in the lower aqueous layer. The lower aqueous layer is collected and is subjected to centrifugation to separate the silica fine particles from sucrose, thereby collecting the silica fine particles. If necessary, centrifugation is repeated to complete the separation. The dispersion liquid is dried to collect the silica fine particles.

Like the magnetic toner, when an external additive other than the silica fine particles has been added, the external additive is also collected. Thus, the external additive is removed from the silica fine particles by centrifugation, for example.

<Method for Measuring Weight-Average Particle Diameter (D4) of Toner>

The weight-average particle diameter (D4) of toner is calculated as described below (the weight-average particle diameter of toner particles is also calculated in the same manner). The measuring apparatus is a precision particle size distribution analyzer "Coulter Counter Multisizer 3" (registered trademark, manufactured by Beckman Coulter, Inc.) having a 100 μm aperture tube utilizing an aperture impedance method. Accessory dedicated software "Beckman Coulter, Multisizer 3 Version 3.51" (manufactured by Beckman Coulter, Inc.) is used to set the measurement conditions and analyze measured data. The effective measuring channel number is 25,000.

An aqueous electrolyte used in the measurement may be approximately 1% by mass special grade sodium chloride dissolved in ion-exchanged water, for example, "ISOTON II" (manufactured by Beckman Coulter, Inc.).

Before the measurement and analysis, the dedicated software is set up as described below.

On the "Standard operation mode (SOM) setting" screen of the dedicated software, the total count number in control mode is set at 50,000 particles, the number of measurements is set at 1, and the Kd value is obtained using "standard particles 10.0 μm" (manufactured by Beckman Coulter, Inc.). A "Threshold/noise level measurement button" is pushed to automatically set the threshold and noise level. The current is set at 1600 μA. The gain is set at 2. Isoton II is chosen as an electrolyte solution. "Flushing of aperture tube after measurement" is checked.

On the "Conversion of pulse into particle diameter" setting screen of the dedicated software, the bin interval is set at logarithmic particle diameter, the particle diameter bin is set at 256 particle diameter bin, and the particle diameter range is set at 2 to 60 μm.

The specific measurement method is as follows:

(1) A 250-ml round-bottom glass beaker for Multisizer 3 is charged with approximately 200 mL of the aqueous electrolyte and is placed on a sample stand. A stirrer rod is rotated counterclockwise at 24 revolutions per second. Soiling and air bubbles in the aperture tube are removed using the "Aperture flushing" function of the dedicated software.

(2) A 100-mL flat-bottom glass beaker is charged with approximately 30 mL of the aqueous electrolyte. To the aqueous electrolyte is added approximately 0.3 mL of a dispersant "Contaminon N" (a 10% by mass aqueous neutral detergent for cleaning precise measuring instruments composed of a nonionic surfactant, an anionic surfactant, and an organic builder, pH 7, manufactured by Wako Pure Chemical Industries, Ltd.) diluted approximately 3-fold by mass with ion-exchanged water.

(3) An ultrasonic disperser "Ultrasonic Dispersion System Tetora 150" (manufactured by Nikkaki-Bios Co., Ltd.) is prepared. The ultrasonic disperser includes two oscillators having an oscillation frequency of 50 kHz and has an electrical output of 120 W. The two oscillators have a phase difference of 180 degrees. A water tank of the ultrasonic disperser is charged with approximately 3.3 L of ion-exchanged water. Approximately 2 mL of Contaminon N is added to the ion-exchanged water.

(4) The beaker prepared in (2) is placed in a beaker-holding hole in the ultrasonic disperser, and the ultrasonic disperser is actuated. The vertical position of the beaker is adjusted such that the surface resonance of the aqueous electrolyte in the beaker is highest.

(5) While the aqueous electrolyte in the beaker prepared in (4) is exposed to ultrasonic waves, approximately 10 mg of toner is added little by little to the aqueous electrolyte and is dispersed. The ultrasonic dispersion treatment is continued for another 60 seconds. During the ultrasonic dispersion, the water temperature of the water tank is controlled at a temperature in the range of 10° C. to 40° C.

(6) The aqueous electrolyte containing dispersed toner prepared in (5) is added dropwise using a pipette into the round-bottom beaker prepared in (1) placed on the sample stand such that the measurement concentration is approximately 5%. Measurement is continued until the number of measured particles reaches 50,000.

(7) The measured data are analyzed by using the accessory dedicated software to determine the weight-average particle diameter (D4). The weight-average particle diameter (D4) is the "Average diameter" on the "Analysis/volume statistics (arithmetic mean)" screen in the setting of graph/% by volume in the dedicated software.

<Method for Measuring Number-Average Particle Diameter of Primary Particles of Silica Fine Particles>

The number-average particle diameter of primary particles of silica fine particles is determined from an image of the silica fine particles on a toner surface taken using a Hitachi ultrahigh resolution field-emission scanning electron microscope S-4800 (Hitachi High-Technologies Corporation). The image capturing conditions for the S-4800 are as follows:

(1) Sample Preparation

A small amount of electrically conductive paste is applied to a sample stage (aluminum sample stage 15 mm×6 mm). The sample stage is sprayed with toner. An excessive toner is removed from the sample stage by air blowing. The electrically conductive paste is thoroughly dried. The sample stage is placed in a sample holder. The sample stage height is adjusted to be 36 mm using a sample height gage.

(2) Observation Conditions for S-4800

The number-average particle diameter of primary particles of silica fine particles is determined from an image taken in the backscattered electron image observation using the S-4800. The particle diameter of silica fine particles can be measured more accurately in backscattered electron images than in secondary electron images because the silica fine particles are less charged up in the backscattered electron images than in the secondary electron images.

An anti-contamination trap of the mirror body of the S-4800 is filled with liquid nitrogen for 30 minutes. "PCSTEM" of the S-4800 is actuated, and flushing (cleaning of an electron source FE chip) is performed. An accelerating voltage indication of a control panel on the screen is clicked. A [flushing] button is pressed to open a flushing dialog. It is confirmed that the flushing intensity is 2, and flushing is performed. It is confirmed that the emission electric current by flushing ranges from 20 to 40 μA. The sample holder is inserted into a sample chamber of the S-4800 mirror body. A [starting point] on the control panel is pressed to move the sample holder to the observation point.

The accelerating voltage indication is clicked to open an HV setting dialog. The accelerating voltage is set at [0.8 kV], and the emission electric current is set at [20 μA]. In a [Basis] tab on the operation panel, the signal selection is set at [SE], [up (U)] and [+BSE] for an SE detector is selected, and [L.A.100] is selected in a selection box on the right side of [+BSE] to adopt a backscattered electron image observation mode. In the same [Basis] tab on the operation panel, the probe current of the electron optical system condition block is set at [Normal], the focal point mode is set at [UHR], and WD is set at [3.0 mm]. An [ON] button of the accelerating voltage indication on the control panel is pressed to apply the accelerating voltage.

(3) Calculation of Number-Average Particle Diameter (D1) of Silica Fine Particles ("da" for Use in Calculation of Theoretical Coverage)

A magnification indication on the control panel is dragged to set the magnification at 100,000 (100 k). A focus knob [COARSE] on the operation panel is rotated to adjust the focus to some extent, and the aperture alignment is adjusted. An [Align] on the control panel is clicked to display an alignment dialog, and [Beam] is chosen. STIGMA/ALIGNMENT knobs (X,Y) on the operation panel is rotated, and an indicated beam is moved to the center of concentric circles. An [aperture] is then chosen, and each of the STIGMA/ALIGNMENT knobs (X,Y) is rotated to stop or minimize the movement of an image. The aperture dialog is closed, and the focus is adjusted by autofocusing. This operation is repeated twice to adjust the focus.

After that, the particle diameters of at least 300 silica fine particles on the toner surface are measured and averaged. Since some silica fine particles form cohesion clusters, the maximum diameters of primary particles are measured and arithmetically averaged to determine the number-average particle diameter (D1) of the primary particles of the silica fine particles.

<Method for Measuring Average Circularity of Toner Particles>

The average circularity of toner particles is measured using a flow particle image analyzer "FPIA-3000" (manufactured by SYSMEX Corporation) under measurement and analysis conditions for calibration.

The specific measurement method is as follows: First, a glass container is charged with approximately 20 mL of ion-exchanged water from which solid impurities are removed in advance. To the ion-exchanged water is added approximately 0.2 mL of a dispersant "Contaminon N" (a 10% by mass aqueous neutral detergent for cleaning precise measuring instruments composed of a nonionic surfactant, an anionic surfactant, and an organic builder, pH 7, manufactured by Wako Pure Chemical Industries, Ltd.) diluted approximately 3-fold by mass with ion-exchanged water. Approximately 0.02 g of a sample is also added to the ion-exchanged water and is dispersed using an ultrasonic homogenizer for 2 minutes, thus preparing a dispersion liquid for measurement. The dispersion liquid is cooled to a temperature in the range of 10° C. to 40° C. The ultrasonic homogenizer is a table-top ultrasonic cleaner homogenizer having an oscillation frequency of 50 kHz and an electrical output of 150 W (for example, "VS-150" (VELVO-CLEAR)). Approximately 2 mL of Contaminon N is added to a predetermined amount of ion-exchanged water in a water tank.

The flow particle image analyzer equipped with an objective lens "UPlanApo" (magnification: 10, numerical aperture: 0.40) is used in the measurement. The sheath liquid is a particle sheath "PSE-900A" (SYSMEX Corporation). The dispersion liquid prepared through the procedures described above is introduced into the flow particle image analyzer. 3000 toner particles are measured in an HPF measurement mode and a total count mode. The binarization threshold in particle analysis is 85%. The analysis particle diameter is an circle-equivalent diameter in the range of 1.985 to 39.69 μm. The average circularity of toner particles is determined.

Before measurement, automatic focusing control is performed using standard latex particles (for example, "RESEARCH AND TEST PARTICLES Latex Microsphere Suspensions 5200A" manufactured by Duke Scientific Corp. diluted with ion-exchanged water). Focusing control can be performed every 2 hours after the start of measurement.

The flow particle image measuring apparatus is calibrated by SYSMEX Corporation and is issued with a calibration certificate from SYSMEX Corporation. Measurement is performed under measurement and analysis conditions for calibration certificate except that the analysis particle diameter is a circle-equivalent diameter in the range of 1.985 μm or more and less than 39.69 μm.

The measurement principle of the flow particle image measuring apparatus "FPIA-3000" (manufactured by SYSMEX Corporation) is the image analysis of a still image of flowing particles. A sample in a sample chamber is fed into a flat sheath flow cell using a sample suction syringe. The sample in the flat sheath flow forms a flat flow between sheath liquid flows. The sample passing through the flat sheath flow cell is irradiated with stroboscopic light at intervals of 1/60 seconds. Thus, flowing particles can be captured as a still image. Furthermore, it is easy to bring the flat flow into focus. Particle images are taken using a CCD camera. The images are subjected to image processing at an image processing resolution of 512×512 pixels (0.37×0.37 μm per pixel). Each particle image is subjected to outline extraction to measure the projected area S and perimeter L of the particle image.

The area S and perimeter L are used to determine the circle-equivalent diameter and circularity. The circle-equivalent diameter is the diameter of a circle having the same area as the projected area of the particle image. The circularity is defined by dividing the perimeter of a circle having the circle-equivalent diameter by the perimeter of the particle projection image and is calculated using the following equation:

$$\text{Circularity}=2\times(\pi\times S)^{1/2}/L$$

A circular particle image has a circularity of 1.000. The circularity decreases with increasing unevenness of the periphery of a particle image. After the circularity of each particle is calculated, an area having a circularity in the range of 0.200 to 1.000 is divided into 800 sections. The arithmetic mean of the circularities is calculated as an average circularity.

<Method for Measuring Apparent Density of Silica Fine Particles>

A 100-mL graduated cylinder is slowly filled up to 100 mL with a sample put on paper. The apparent density is calculated using the following equation from the increase in mass of the graduated cylinder due to the addition of the sample. The paper should not be tapped during filling the graduated cylinder with the sample.

$$\text{Apparent density(g/L)}=(\text{Mass(g) of 100 ml of sample})/0.1$$

<Method for Measuring True Specific Gravity of Toner and Silica Fine Particles>

The true specific gravity of toner and silica fine particles is measured using a dry-process automatic densitometer autopycnometer (manufactured by Yuasa Ionics Co., Ltd.). The measurement conditions are as follows:

Cell: SM cell (10 mL)

Amount of sample: Approximately 2.0 g (toner), 0.05 g (silica fine particles)

This measurement method is based on a gas phase substitution method. The true specific gravity of a solid or a liquid can be measured. Like the liquid phase substitution method, the measurement method is based on the Archimedes' principle. Since the substitution medium is a gas (argon gas), the measurement method has high precision for micropores.

<Method for Measuring Rate of Hydrolysis of Silane Compound>

The rate of hydrolysis of a silane compound will be described below. A hydrolysis treatment of an alkoxysilane yields a mixture of a hydrolysate, unhydrolyzed alkoxysilane, and a condensate. The rate of hydrolysis is the percentage of the hydrolysate in the mixture. The mixture corresponds to the silane compound described above.

The hydrolysis reaction of an alkoxysilane will be described below for the case of methoxysilane. The hydrolysis of methoxysilane converts the methoxy group into a hydroxy group and forms methanol. Thus, the degree of hydrolysis can be determined from the ratio of the amount of methoxy group to the amount of methanol. In an embodiment of the present invention, the rate of hydrolysis is determined from the ratio measured by 1H-nuclear magnetic resonance (NMR). The specific measurement and calculation method for methoxysilane will be described below.

First, the 1H-nuclear magnetic resonance (NMR) of methoxysilane before the hydrolysis treatment is measured using deuteriochloroform. The peak position of the methoxy group is identified. After that, methoxysilane is converted into a silane compound by hydrolysis treatment. The hydrolysis reaction is terminated when the aqueous silane compound solution immediately before the addition to an untreated magnetic material has pH 7.0 and a temperature of 10° C. Water is removed from the aqueous solution to yield a dry silane compound. After a small amount of deuteriochloroform is added to the dry silane compound, 1H-NMR is measured. The peak of the methoxy group in the resulting spectrum is identified from the predetermined peak position. The rate of hydrolysis is calculated using the following equation, wherein A denotes the peak area of the methoxy group, and B denotes the peak area of the methyl group of methanol.

$$\text{Rate of hydrolysis (\%)}=\{B/(A+B)\}\times 100$$

The 1H-NMR measurement conditions are as follows:

Measuring apparatus: FT NMR JNM-EX400 (manufactured by JEOL Ltd.)

Measurement frequency: 400 MHz

Pulse condition: 5.0 μs

Frequency range: 10,500 Hz

Number of scans: 1024

Measurement temperature: 40° C.

<Method for Measuring Acid Value of Polyester Resin>

The acid value of a polyester resin is measured according to JIS K 1557-1970. The specific measurement method will be described below. 2.0 g of a ground sample is weighed (W (g)). The sample in a 200-mL Erlenmeyer flask is dissolved in 100 mL of a toluene/ethanol (2:1) mixed solution for 5 hours. A phenolphthalein solution is added to the solution as an indicator. The solution is titrated with a 0.1 N KOH alcohol solution in a burette. The amount of KOH solution is denoted as S (ml). The amount of KOH solution in a blank test is denoted as B (mL).

The acid value is calculated using the following equation.

$$\text{Acid value}=[(S-B)\times f\times 5.61]/W$$

(f: Factor of KOH solution)

<Method for Measuring Amount of Components Eluted from Silane Compound Contained in Treated Magnetic Material Using Styrene>

A 50-mL glass vial is charged with 20 g of styrene and 1.0 g of a treated magnetic material and is placed in a "KM Shaker" (model: V.SX) manufactured by Iwaki Co. Ltd. The glass vial is shaken at a speed of 50 for 1 hour to allow the surface-treating agent in the treated magnetic material to be eluted by styrene. The treated magnetic material is then separated from styrene and is thoroughly dried in a vacuum dryer.

The carbon contents per unit weight of the dried treated magnetic material and the treated magnetic material before elution with styrene are measured using a carbon-sulfur analyzer EMIA-320V manufactured by Horiba, Ltd. The rate of elution of a silane compound in the treated magnetic material using styrene is calculated from the carbon contents before and after elution with styrene. The amount of sample in the measurement using EMIA-320V is 0.20 g. The combustion improver is tungsten and tin.

<Method for Measuring Dissolution Rate of Iron Element and Amount of Silicon>

In an embodiment of the present invention, the dissolution rate of elemental iron in a magnetic material, and the amount of metallic elements other than iron as a function of the dissolution rate of elemental iron are determined by using the following method. More specifically, 3 L of deionized water in a 5-L beaker is heated to 50° C. in a water bath. 25 g of a magnetic material is stirred in the deionized water. Special grade hydrochloric acid is then added to the deionized water to produce 3 mol/L aqueous hydrochloric acid, thereby dissolving the magnetic material. From the start to the end of dissolution at which the solution becomes transparent, samples are taken a dozen or so times and are filtered through a membrane filter having a sieve opening of 0.1 μm. Filtrates are collected. The filtrates are subjected to inductively coupled plasma (ICP) emission spectroscopy to determine the amounts of elemental iron and metallic elements other than elemental iron. The dissolution rate of elemental iron in each sample is calculated using the following equation.

$$\text{Dissolution rate of elemental iron}=(\text{Concentration of elemental iron in sample}/\text{Concentration of elemental iron in complete dissolution})\times 100$$

The silicon content of each sample is determined. The silicon content at the point when the dissolution rate of elemental iron reaches 5% is determined from the relationship between the dissolution rate of elemental iron calculated as described above and the amount of detected elements.

<SEC-MALLS Measurements(Mw,Rw,Mn(25° C.)) of Toner at 25° C.>

The weight-average molecular weight Mn, the average radius of gyration Rw, and the number-average molecular weight Mn (25° C.) of tetrahydrofuran-soluble matter in a toner according to an embodiment of the present invention at 25° C. are determined by size exclusion chromatography-multi-angle laser light scattering (SEC-MALLS).

0.03 g of toner is dispersed in 10 mL of tetrahydrofuran, is shaken using a shaker at 25° C. for 24 hours, and is filtered through a 0.2 μm filter. The filtrate is used as a sample.

[Analytical Conditions]
Separation column: Shodex (TSK GMHHR-H HT20)×2
Column temperature: 25° C.
Mobile phase solvent: Tetrahydrofuran
Mobile phase flow rate: 1.0 mL/min.
Sample concentration: approximately 0.3%
Injected amount: 300 μL
Detector 1: Multi-angle laser light scattering detector Wyatt DAWN EOS
Detector 2: Differential refractive index detector Shodex RI-71

ASTRA for Windows (registered trademark) 4.73.04 (Wyatt Technology Corp.) is used for data analysis.

<Method for Measuring Tetrahydrofuran-Insoluble Matter Content>

Approximately 1.5 g of toner is weighed (W1 g). The toner is put into a filter paper thimble (for example, trade name No. 86R (size: 28×100 mm), manufactured by Advantec Toyo Kaisha, Ltd.), which is weighed in advance. The filter paper is placed in a Soxhlet extractor. Soxhlet extraction is performed for 10 hours using 200 mL of tetrahydrofuran as a solvent. The reflux rate is such that the solvent extraction cycle is approximately 5 minutes.

After the completion of the extraction, the filter paper thimble is removed, is air-dried, and is dried under vacuum at 40° C. for 8 hours. The mass of the extract residue (W2 g) is determined by deducting the mass of the filter paper thimble from the mass of the filter paper thimble containing the extract residue.

The amount of components other than the resin component (W3 g) is determined through the following procedures. Approximately 2 g of toner is weighed (Wa g) in a 30-mL magnetic crucible, which is weighed in advance. The crucible is heated in an electric furnace at approximately 900° C. for approximately 3 hours, is left to cool in the electric furnace, and is left to cool in a desiccator at normal temperature for 1 hour or more. The mass of incineration residue (Wb g) is determined by deducting the mass of the crucible from the mass of the crucible containing the incineration residue. The mass of the incineration residue (W3 g) in W1 g of the sample is calculated using the following equation.

$$W3=W1\times(Wb/Wa)$$

In this case, the tetrahydrofuran-insoluble matter (% by mass) is calculated using the following equation.

$$\text{Tetrahydrofuran-insoluble matter (\% by mass)}=\{(W2-W3)/(W1-W3)\}\times 100$$

EXAMPLES

The present invention will be more specifically described with production examples and exemplary embodiments. The present invention is not limited to these examples. The parts in the following compositions represent parts by mass.

<Production Example 1 of Magnetic Iron Oxide>

50 L of aqueous iron (II) sulfate containing 2.0 mol/L $Fe^{2+}$ was mixed with 55 L of 4.0 mol/L aqueous sodium hydroxide to produce an aqueous iron (II) salt solution containing iron (II) hydroxide colloid. While the aqueous solution was held at 85° C., air was blown into the aqueous solution at 20 L/min to perform an oxidation reaction, thereby producing a slurry containing core particles.

The slurry was filtered and washed in a filter press. The core particles were dispersed again in water to form a reslurry. Sodium silicate was added to the reslurry such that silicon constituted 0.20% by mass of 100 parts of the core particles. The reslurry was stirred at a pH of 6.0 to produce magnetic material particles having a silicon-rich surface. The reslurry was filtered and washed in a filter press and was reslurried in ion-exchanged water. The reslurry (solid content: 50 g/L) was subjected to ion exchange with 500 g (10% by mass of the magnetic material) of ion-exchange resin SK110 (manufactured by Mitsubishi Chemical Corporation) for 2 hours. The ion-exchange resin was filtered out through a mesh. The reslurry was filtered and washed in a filter press, was dried, and was crushed to form magnetic iron oxide 1 having a number-average particle diameter of 0.23 μm.

<Production Example 2 of Magnetic Iron Oxide>

Magnetic iron oxide 2 having a volume-average particle diameter of 0.23 μm was produced in the same manner as in the production of the magnetic iron oxide 1 except that the amount of sodium silicate was 0.05 parts.

<Production Example 3 of Magnetic Iron Oxide>

Magnetic iron oxide 3 having a volume-average particle diameter of 0.23 μm was produced in the same manner as in the production of the magnetic iron oxide 1 except that the amount of sodium silicate was 0.5 parts.

<Production Example of Silane Compound 1>

30 parts of n-hexyltrimethoxysilane was added dropwise to 70 parts of ion-exchanged water while stirring. The aqueous solution was held at a pH of 5.5 and at a temperature of 60° C. and was hydrolyzed while dispersing using dispersing impellers at a peripheral speed of 0.46 m/s for 120 minutes. The pH of the aqueous solution was then changed to 7.0, and the aqueous solution was cooled to 10° C. to stop the hydrolysis reaction. Thus, an aqueous solution containing a silane compound 1 was obtained. The silane compound 1 had a hydrolysis rate of 99%.

Production Examples of Silane Compounds 2 to 5

Silane compounds 2 to 5 were produced in the same manner as in the Production Example of the silane compound 1 except that the type of silane compound, pH, temperature, and time were changed as listed in Table 1.

Table 1 shows the physical properties of the resulting silane compounds.

TABLE 1

| | Type of silane compound | pH | Temperature (° C.) | Time (min) | Number of carbon atoms | Hydrolysis rate (%) |
|---|---|---|---|---|---|---|
| Silane compound 1 | n-Hexyltrimethoxysilane | 5.5 | 60 | 120 | 6 | 99 |
| Silane compound 2 | n-Hexyltrimethoxysilane | 5.5 | 60 | 30 | 6 | 50 |
| Silane compound 3 | n-Octyltrimethoxysilane | 5 | 60 | 180 | 8 | 99 |
| Silane compound 4 | n-Decyltrimethoxysilane | 4.5 | 60 | 240 | 10 | 99 |

TABLE 1-continued

| | Type of silane compound | pH | Temperature (° C.) | Time (min) | Number of carbon atoms | Hydrolysis rate (%) |
|---|---|---|---|---|---|---|
| Silane compound 5 | Isobutyltrimethoxysilane | 5.5 | 55 | 120 | 4 | 99 |

<Production Example of Magnetic Material 1>

100 parts of the magnetic iron oxide 1 was stirred in a high-speed mixer (LFS-2 manufactured by Fukae Powtec Corporation) at 2000 rpm. 8.0 parts of an aqueous solution containing the silane compound 1 was added dropwise to the magnetic iron oxide 1 for 2 minutes. The magnetic iron oxide 1 was stirred for another 5 minutes. In order to increase the adhesion of the silane compound 1, the magnetic iron oxide 1 was then dried at 50° C. for 2 hours to decrease the water content. The magnetic iron oxide 1 was dried at 110° C. for 4 hours to allow the condensation reaction of the silane compound 1 to proceed. The magnetic iron oxide 1 was then crushed and was passed through a sieve having a sieve opening of 100 μm to produce a magnetic material 1. Table 2 shows the physical properties of the magnetic material 1.

<Production of Magnetic Materials 2 to 9>

Magnetic materials 2 to 9 were produced in the same manner as in the production of the magnetic material 1 except that the types of magnetic iron oxide and silane compound and the amounts thereof were changed as listed in Table 2. Table 2 shows the physical properties of the magnetic materials 2 to 9.

TABLE 2

| | Magnetic iron oxide | Silane compound | Parts of aqueous silane compound solution (parts by mass) | Amount of surface silicon of magnetic iron oxide | Amount of residual carbon after washing with styrene (mass %) | Treatment method |
|---|---|---|---|---|---|---|
| Magnetic material 1 | Magnetic iron oxide 1 | Silane compound 1 | 8.0 (30% aqueous solution) | 0.2 | 0.90 | Gas phase |
| Magnetic material 2 | Magnetic iron oxide 1 | Silane compound 2 | 8.0 (30% aqueous solution) | 0.2 | 0.80 | Gas phase |
| Magnetic material 3 | Magnetic iron oxide 2 | Silane compound 1 | 8.0 (30% aqueous solution) | 0.05 | 0.82 | Gas phase |
| Magnetic material 4 | Magnetic iron oxide 3 | Silane compound 1 | 8.0 (30% aqueous solution) | 0.5 | 0.98 | Gas phase |
| Magnetic material 5 | Magnetic iron oxide 1 | Silane compound 1 | 5.0 (30% aqueous solution) | 0.2 | 0.40 | Gas phase |
| Magnetic material 6 | Magnetic iron oxide 1 | Silane compound 1 | 10.0 (30% aqueous solution) | 0.2 | 1.20 | Gas phase |
| Magnetic material 7 | Magnetic iron oxide 1 | Silane compound 3 | 8.0 (30% aqueous solution) | 0.2 | 1.00 | Gas phase |
| Magnetic material 8 | Magnetic iron oxide 1 | Silane compound 4 | 8.0 (30% aqueous solution) | 0.2 | 1.20 | Gas phase |
| Magnetic material 9 | Magnetic iron oxide 1 | Silane compound 5 | 7.0 (30% aqueous solution) | 0.2 | 0.50 | Gas phase |

<Comparative Magnetic Material 1>

Aqueous iron (II) sulfate was mixed with a sodium hydroxide solution (containing sodium hexametaphosphate, P content: 1% by mass of Fe) to prepare an aqueous solution containing iron (II) hydroxide. The equivalent ratio of sodium hydroxide to iron ion ranged from 1.0 to 1.1. While the pH of the aqueous solution was held at 9, air was blown into the aqueous solution to perform an oxidation reaction at a temperature in the range of 80° C. to 90° C., thereby producing a slurry in which seed crystals were to be formed.

Aqueous iron (II) sulfate was then added to the slurry such that the amount of alkali ranged from 0.9 to 1.2 equivalent to the initial amount of alkali (a sodium component of sodium hydroxide). While the slurry was held at a pH of 8, air was blown into the slurry to perform an oxidation reaction. At the end of the oxidation reaction, the pH was adjusted to be approximately 6, and 1.0 parts of n-hexyltrimethoxysilane per 100 parts of magnetic iron oxide was added as a silane coupling agent to the slurry. The slurry was well stirred. The resulting hydrophobic iron oxide particles were washed, filtered, and dried through the routine procedures. Aggregated particles were crushed to produce a comparative magnetic material 1. The amount of residual carbon of the comparative magnetic material 1 after washing with styrene was 0.35% by mass.

<Comparative Magnetic Material 2>

50 L of aqueous iron (II) sulfate containing 2.0 mol/L $Fe^{2+}$ was mixed with 55 L of 4.0 mol/L aqueous sodium hydroxide to produce an aqueous iron (II) salt solution containing iron (II) hydroxide colloid. While the aqueous solution was held at 85° C., air was blown into the aqueous solution at 20 L/min to perform an oxidation reaction, thereby producing a slurry containing core particles.

The slurry was filtered and washed in a filter press. The core particles were dispersed again in water to form a reslurry.

Sodium silicate was added to the reslurry such that silicon constituted 0.10% by mass of 100 parts of the core particles. The reslurry was stirred at a pH of 6.0 to produce magnetic iron oxide particles having a silicon-rich surface. The reslurry was filtered and washed in a filter press and was reslurried in ion-exchanged water. The reslurry (solid content: 50 g/L) was subjected to ion exchange with 500 g (10% by mass of the magnetic iron oxide) of ion-exchange resin SK110 (manufactured by Mitsubishi Chemical Corporation) for 2 hours. The ion-exchange resin was filtered out through a mesh. The reslurry was filtered and washed in a filter press, was dried, and was crushed to form magnetic iron oxide particles having a volume-average particle diameter of 0.21 μm. 40 parts of isobutyltrimethoxysilane was then added dropwise to 60 parts of ion-exchanged water while stirring. The aqueous solution was held at a pH of 5.3 and at a temperature of 40° C. and was hydrolyzed while dispersing using dispersing impellers at a peripheral speed of 0.46 m/s for 2.0 hours. The pH of the aqueous solution was then changed to 7.0, and the aqueous solution was cooled to 10° C. to stop the hydrolysis reaction. Thus, an aqueous solution containing a silane compound was obtained. The silane compound had a hydrolysis rate of 95% and a self-condensation rate of 16%.

100 parts of the magnetic iron oxide particles were stirred in a high-speed mixer (LFS-2 manufactured by Fukae Powtec Corporation) at 2000 rpm. 8.5 parts of an aqueous solution containing the silane compound 1 was added dropwise to the magnetic iron oxide particles for 2 minutes. The magnetic iron oxide particles were stirred for another 3 minutes. The mixture was then dried at 120° C. for 1 hour, and the silane compound was subjected to a condensation reaction. The magnetic iron oxide particles were then crushed and were passed through a sieve having a sieve opening of 100 μm to produce a comparative magnetic material 2. The amount of residual carbon of the comparative magnetic material 2 after washing with styrene was 0.35% by mass.

<Comparative Magnetic Material 3>

An iron (II) sulfate solution was mixed with aqueous sodium hydroxide to produce an aqueous iron (II) salt solution containing $Fe(OH)_2$. The equivalent ratio of aqueous sodium hydroxide to $Fe^{2+}$ was 0.95.

Sodium silicate was then added to the aqueous iron (II) salt solution such that the amount of silicon was 1.0% by mass of the amount of elemental iron. Air was then blown into the aqueous iron (II) salt solution containing $Fe(OH)_2$ at a temperature of 90° C. to perform an oxidation reaction at a pH in the range of 6 to 7.5, thereby producing magnetic iron oxide particles containing silicon.

An aqueous sodium hydroxide in which 0.1% by mass (the equivalent ratio of silicon to elemental iron) sodium silicate was dissolved was added to the suspension. The amount of aqueous sodium hydroxide was 1.05 equivalent to the amount of residual $Fe^{2+}$. The suspension was heated at a temperature of 90° C. to perform an oxidation reaction at a pH in the range of 8 to 11.5, thereby forming magnetic iron oxide particles containing silicon.

The magnetic iron oxide particles were filtered, washed, and dried through the routine procedures. Since the primary particles of the magnetic iron oxide particles formed aggregates, the magnetic iron oxide particles were treated in a mix muller to crush the aggregates into primary particles and smooth the surface of the magnetic iron oxide particles, thus producing smooth-surfaced magnetic iron oxide particles.

100 parts of smooth-surfaced magnetic iron oxide particles were then charged into a Simpson mix muller and were uniformly sprayed with 3 parts (corresponding to 0.3 parts of decyltrimethoxysilane) of a methanol solution of 10% by mass decyltrimethoxysilane having an alkyl group having ten carbon atoms, which was a silane coupling agent (silylation reagent). The Simpson mix muller was then operated at a temperature in the range of 50° C. to 60° C. for 45 minutes to produce a comparative magnetic material 3. The amount of residual carbon of the comparative magnetic material 3 after washing with styrene was 0.25% by mass.

<Synthesis of Polyester Resin 1>

The following components were charged into a reaction vessel equipped with a cooling tube, a mixer, and a nitrogen inlet and was allowed to react at 230° C. in a nitrogen stream for 10 hours while produced water was distilled off.

| | |
|---|---|
| Bisphenol A adduct with 2 mol of EO | 350 parts |
| Bisphenol A adduct with 2 mol of PO | 326 parts |
| Terephthalic acid | 250 parts |
| Titanium catalyst (titanium dihydroxybis(triethanolaminate)) | 2 parts |

The components were then allowed to react at a reduced pressure in the range of 5 to 20 mmHg, and was cooled to 180° C. at the point in time when the acid value reached 0.1 mgKOH/g or less. 80 parts of trimellitic anhydride was added to the product. After the reaction at normal pressure in an enclosed space for 2 hours, the product was removed, was cooled to room temperature, and was pulverized to produce a polyester resin 1. The resin had an acid value of 8 mgKOH/g.

<Synthesis of Polyester Resins 2 to 4>

Polyester resins 2 to 4 were produced in the same manner as in the production of the polyester resin 1 except that the amount of trimellitic anhydride was changed. Table 3 shows the physical properties of the resulting resins.

TABLE 3

| Polyester resin | Amount of trimellitic anhydride (parts by mass) | Acid value (mgKOH/g) |
|---|---|---|
| Polyester resin 1 | 80 | 8 |
| Polyester resin 2 | 60 | 6 |
| Polyester resin 3 | 100 | 10 |
| Polyester resin 4 | 120 | 12 |

<Manufacture of Magnetic Toner Particles 1>

450 parts of an aqueous solution of 0.1 mol/L $Na_3PO_4$ in 720 parts of ion-exchanged water was heated to a temperature of 60° C. 67.7 parts of an aqueous solution of 1.0 mol/L $CaCl_2$ was added to the solution to produce an aqueous medium containing a dispersion stabilizer.

| | |
|---|---|
| Styrene | 78 parts |
| n-butyl acrylate | 22 parts |
| Divinylbenzene | 0.5 parts |
| Polyester resin 1 | 3 parts |
| Negative charge control agent T-77 (manufactured by Hodogaya Chemical Co., Ltd.) | 1 part |
| Magnetic material 1 | 90 parts |

These components were uniformly dispersed in an attritor (Mitsui Miike Machinery Co., Ltd.). This monomer composition was heated to a temperature of 60° C. and was mixed with 15 parts of a paraffin wax (HNP-9: manufactured by Nippon Seiro Co., Ltd.), which served as a release agent, and 4 parts of a polymerization initiator di(sec-butyl) peroxydicarbonate (10-hour half-life temperature: 51° C.) The mixture was dissolved to yield a polymerizable monomer composition.

The polymerizable monomer composition was stirred in the aqueous medium using a TK homo mixer (Tokushu Kika Kogyo Co., Ltd.) at a temperature of 60° C. in a $N_2$ atmosphere at 10,000 rpm for 15 minutes to form particles of the polymerizable monomer composition. The particles of the polymerizable monomer composition were stirred using a paddle stirring blade and were polymerized at a reaction temperature of 70° C. (19° C. higher than the 10-hour half-life temperature of the polymerization initiator) for 360 minutes. The suspension was then cooled to room temperature at 3° C./min. Hydrochloric acid was added to dissolve the dispersant. The suspension was filtered, was washed with water, and was dried to produce magnetic toner particles 1.

<Manufacture of Magnetic Toner Particles 2 to 16 and 18 to 22>

Magnetic toner particles 2 to 16 and 18 to 22 were manufactured in the same manner as in the manufacture of the magnetic toner particles 1 except that the types of polyester resin and magnetic material and the polymerization conditions were changed as shown in Table 3.

<Manufacture of Magnetic Toner Particles 17>

Magnetic toner particles 17 were manufactured in the same manner as in the manufacture of the magnetic toner particles 1 except that the amount of polymerization initiator di(sec-butyl) peroxydicarbonate (10-hour half-life temperature: 51° C.) was changed from 4 parts to 8 parts, the polymerization reaction was performed at a reaction temperature of 70° C. (19° C. higher than the 10-hour half-life temperature of the polymerization initiator) for 240 minutes, another 1 part of di(sec-butyl) peroxydicarbonate was added at a reaction time of 240 minutes, and the polymerization reaction was performed at a reaction temperature of 70° C. for 120 minutes.

TABLE 4

| Toner | | Magnetic material | | Initiator | | Reaction | |
|---|---|---|---|---|---|---|---|
| particles No. | Polyester resin | Type | Amount (parts) | Type | Amount (parts) | temperature (° C.) | Note |
| 1 | 1 | 1 | 90 | Di(sec-butyl) peroxydicarbonate | 4 | 70 | |
| 2 | 2 | 1 | 90 | Di(sec-butyl) peroxydicarbonate | 4 | 70 | |
| 3 | 3 | 1 | 90 | Di(sec-butyl) peroxydicarbonate | 4 | 70 | |
| 4 | 1 | 2 | 90 | Di(sec-butyl) peroxydicarbonate | 4 | 70 | |
| 5 | 1 | 3 | 90 | Di(sec-butyl) peroxydicarbonate | 4 | 70 | |
| 6 | 1 | 4 | 90 | Di(sec-butyl) peroxydicarbonate | 4 | 70 | |
| 7 | 1 | 5 | 90 | Di(sec-butyl) peroxydicarbonate | 4 | 70 | |
| 8 | 1 | 6 | 90 | Di(sec-butyl) peroxydicarbonate | 4 | 70 | |
| 9 | 1 | 7 | 90 | Di(sec-butyl) peroxydicarbonate | 4 | 70 | |
| 10 | 1 | 8 | 90 | Di(sec-butyl) peroxydicarbonate | 4 | 70 | |
| 11 | 1 | 9 | 90 | Di(sec-butyl) peroxydicarbonate | 4 | 70 | |
| 12 | 1 | 1 | 70 | Di(sec-butyl) peroxydicarbonate | 4 | 70 | |
| 13 | 1 | 1 | 100 | Di(sec-butyl) peroxydicarbonate | 4 | 70 | |
| 14 | 1 | 1 | 90 | Diisononanoyl peroxide | 5 | 70 | |
| 15 | 1 | 1 | 90 | Di(sec-butyl) peroxydicarbonate | 8 | 70 | |
| 16 | 1 | 1 | 90 | Diisononanoyl peroxide | 7 | 66 | |
| 17 | 1 | 1 | 90 | Di(sec-butyl) peroxydicarbonate | 8 | 70 | Stepwise addition of initiator |
| 18 | 1 | 1 | 90 | Diisononanoyl peroxide | 9 | 70 | |
| 19 | 1 | 1 | 90 | Diisononanoyl peroxide | 4 | 70 | |
| 20 | 1 | 1 | 70 | Diisononanoyl peroxide | 5 | 70 | |
| 21 | 1 | 1 | 100 | Di(sec-butyl) peroxydicarbonate | 8 | 70 | |
| 22 | 1 | 1 | 110 | Di(sec-butyl) peroxydicarbonate | 8 | 70 | |

<Production Example 1 of Silica Fine Particles>

A silica raw material (the number-average particle diameter of primary particles=9 nm) in an autoclave equipped with a mixer was heated to 200° C. while stirring.

The interior of the reactor was purged with nitrogen gas and was hermetically sealed. 25 parts of hexamethyldisilazane per 100 parts of the silica raw material was sprayed into the interior. A silane compound treatment was performed while the silica flowed. The reaction was continued for 60 minutes. After the completion of the reaction, the pressure of the autoclave was released, and the autoclave was purged with a nitrogen gas stream to remove an excessive amount of hexamethyldisilazane and by-products from hydrophobic silica.

While the hydrophobic silica in the reaction vessel was stirred, 100 parts of the silica raw material was sprayed with 10 parts of dimethyl silicone oil (viscosity=100 $mm^2/s$) and was stirred for 30 minutes. The silica raw material was heated to 300° C. while stirring and was stirred for another 2 hours. The silica raw material was then removed and crushed to form silica fine particles 1. Table 5 shows the physical properties of the silica fine particles 1.

<Production Examples 2 to 6 of Silica Fine Particles>

Silica fine particles 2 to 6 were manufactured in the same manner as in the Production Example 1 of silica fine particles except that the particle diameter of untreated silica was changed, and the crushing force was appropriately controlled. Table 5 shows the physical properties of the silica fine particles 2 to 6.

TABLE 5

| | Number-average particle diameter of primary particles (nm) | BET specific surface area ($m^2/g$) | Apparent density (g/L) |
|---|---|---|---|
| Silica fine particles 1 | 9 | 130 | 30 |
| Silica fine particles 2 | 5 | 200 | 48 |
| Silica fine particles 3 | 7 | 180 | 22 |
| Silica fine particles 4 | 15 | 80 | 38 |
| Silica fine particles 5 | 20 | 60 | 16 |
| Silica fine particles 6 | 25 | 50 | 15 |

<Production Example 1 of Magnetic Toner>

The toner particles 1 were mixed with an external additive in the apparatus illustrated in FIG. 3.

In the apparatus illustrated in FIG. 3, the diameter of the inner-area of the main body casing 1 was 130 mm, the volume of the treatment space 9 was $2.0\times10^{-3}$ $m^3$, the rated power of the drive unit 8 was 5.5 kW, and the stirring members 3 had a shape illustrated in FIG. 4. The overlap width d between the stirring members 3*a* and the stirring members 3*b* in FIG. 4 was 0.25D, wherein D denotes the maximum width of the stirring members 3. The clearance between the stirring members 3 and the inner periphery of the main body casing 1 was 3.0 mm.

The apparatus illustrated in FIG. 3 having the structure described above was charged with 100 parts by mass of the toner particles 1 and 0.40 parts by mass of the silica fine particles 1, which were subjected to hydrophobic treatment with silicone oil and a silane coupling agent. The toner particles and the silica fine particles were homogeneously mixed by premixing. Under the premixing conditions, the power of the drive unit 8 was 0.10 W/g (the number of rotation of the drive unit 8 was 150 rpm), and the treatment time was 1 minute. After the completion of the premixing, an external addition and mixing treatment was performed. Under the external addition and mixing treatment conditions, the peripheral speed of the outermost end of the stirring members 3 was adjusted such that the power of the drive unit 8 was constant at 0.60 W/g (the number of rotation of the drive unit 8 was 1400 rpm), and the treatment time was 3 minutes.

0.30 parts by mass of silica fine particles were then added. The peripheral speed of the outermost end of the stirring members 3 was adjusted such that the power of the drive unit 8 was constant at 0.60 W/g (the number of rotation of the drive unit 8 was 1400 rpm), and the treatment was performed for 2 minutes.

After the mixing treatment of the external additive, coarse particles were removed using a circular vibrating shifter equipped with a screen having a diameter of 500 mm and a sieve opening of 75 μm, thereby manufacturing a toner 1. The toner 1 was observed using a scanning electron microscope. The number-average particle diameter of primary particles of silica fine particles on the toner surface was 9 nm. Table 6 shows the external addition conditions for the toner 1. Table 7 shows the physical properties.

<Production Example of Magnetic Toners 2 to 30 and Comparative Magnetic Toners 1 to 9>

Toners 2 to 30 and comparative toners 1 to 9 were manufactured in the same manner as in the Production Example of the magnetic toner 1 except that the type of external additive and the amount thereof, the type of magnetic toner particles, the type of external addition apparatus, and the external addition conditions were changed as listed in Tables 6-1 to 6-6. Tables 6-1 to 6-6 listed the external addition conditions for the toners 2 to 30 and the comparative toners 1 to 9. Table 7 shows the physical properties of these toners.

When a Henschel mixer was used as the external addition apparatus, a Henschel mixer FM10C (Mitsui Miike Machinery Co., Ltd.) was used. In some of the Production Examples, no premixing was performed.

<Manufacture of Comparative Magnetic Toner 10>

450 parts of an aqueous solution of 0.1 mol/L $Na_3PO_4$ in 720 parts of ion-exchanged water was heated to 60° C. 67.7 parts of an aqueous solution of 1.0 mol/L $CaCl_2$ was added to the solution to produce an aqueous medium containing a dispersion stabilizer.

| | |
|---|---|
| Styrene | 78.0 parts |
| n-butyl acrylate | 22.0 parts |
| Divinylbenzene | 0.6 parts |
| Iron complex of monoazo dye (T-77: manufactured by Hodogaya Chemical Co., Ltd.) | 1.5 parts |
| Comparative magnetic material 1 | 90.0 parts |
| Polyester resin 4 (a saturated polyester resin produced by a condensation reaction between an ethylene oxide adduct of bisphenol A and terephthalic acid, Mn = 5000, acid value = 12 mgKOH/g, Tg = 68° C.) | 7.0 parts |

These components were uniformly dispersed and mixed in an attritor (Mitsui Miike Machinery Co., Ltd.) and were heated to 60° C. 15.0 parts of a release agent behenyl behenate (maximum endothermic peak temperature: 70.0° C.) was mixed and dissolved in the components. The components were mixed with 4.5 parts of di(sec-butyl) peroxydicarbonate (10-hour half-life temperature: 51° C.) to produce a monomer composition. The monomer composition was stirred in the aqueous medium using a TK homo mixer (Tokushu Kika Kogyo Co., Ltd.) at 60° C. in a $N_2$ atmosphere at 18.8 m/s for 10 minutes to form particles of the monomer composition. The particles of the monomer composition were heated to 70° C. at 0.5° C./min while stirring using a paddle stirring blade and were allowed to react at 70° C. for 6 hours. The product was heated to 90° C., was held for 2 hours, and was slowly cooled to 30° C. at 0.5° C./min. After cooling, hydrochloric acid was added to the product. The product was washed, filtered, and dried to form magnetic toner particles 23.

The magnetic toner particles 23 were mixed with an external additive in the same manner as in the Production Example 1 of the magnetic toner to form a comparative magnetic toner 10. Table 7 shows the physical properties of the comparative magnetic toner 10.

<Manufacture of Comparative Magnetic Toner 11>

450 parts of an aqueous solution of 0.1 mol/L $Na_3PO_4$ in 720 parts of ion-exchanged water was heated to 60° C. 67.7 parts of an aqueous solution of 1.0 mol/L $CaCl_2$ was added to the solution to produce an aqueous medium containing a dispersion stabilizer.

| | |
|---|---|
| Styrene | 78.0 parts |
| n-butyl acrylate | 22.0 parts |
| Divinylbenzene | 0.6 parts |
| Iron complex of monoazo dye (T-77: manufactured by Hodogaya Chemical Co., Ltd.) | 1.5 parts |
| Comparative magnetic material 2 | 90.0 parts |
| Polyester resin 4 | 7.0 parts |

These components were uniformly dispersed in an attritor (Mitsui Miike Machinery Co., Ltd.) to produce a monomer composition. The monomer composition was heated to 60° C. 12.0 parts of a Fischer-Tropsch wax was mixed with and dissolved in the monomer composition. 7.0 parts of a polymerization initiator dilauroyl peroxide was dissolved in the monomer composition.

The monomer composition was stirred in the aqueous medium using a TK homo mixer (Tokushu Kika Kogyo Co., Ltd.) at 60° C. in a $N_2$ atmosphere at 12,000 rpm for 10 minutes to form particles of the monomer composition. The monomer composition was stirred using a paddle stirring blade and was allowed to react at 74° C. for 6 hours. After the completion of the reaction, the suspension was cooled, and hydrochloric acid was added to the suspension. The suspension was filtered and dried to form magnetic toner particles 24.

The magnetic toner particles 24 were subjected to the external addition and mixing treatment in the same manner as in the Production Example 1 of the magnetic toner to form a comparative magnetic toner 11. Table 7 shows the physical properties of the comparative magnetic toner 11.

<Manufacture of Comparative Magnetic Toner 12>

A four-neck flask equipped with a high-speed mixer TK homo mixer (manufactured by Tokushu Kika Kogyo Co., Ltd.) was charged with 650 parts of ion-exchanged water and 500 parts of an aqueous solution of 0.1 mol/L $Na_3PO_4$. The number of rotation was adjusted to be 12,000 rpm. The four-neck flask was heated to 70° C. 70 parts of an aqueous solution of 1.0 mol/L $CaCl_2$ was slowly added to the resulting mixture to prepare an aqueous dispersion medium containing a minute poorly water-soluble dispersion stabilizer $Ca_3(PO_4)_2$.

| | |
|---|---|
| Styrene | 83 parts |
| n-butyl acrylate | 17 parts |
| Divinylbenzene | 0.2 parts |
| Polyester resin 1 | 4 parts |
| Negative charge control agent (monoazo iron complex) | 2 parts |
| Polyethylene wax (mp = 97° C.) | 10 parts |
| Comparative magnetic material 3 | 90 parts |

The mixture was dispersed using an attritor (manufactured by Mitsui Mining & Smelting Co., Ltd.) for 2 hours. 8 parts of 2,2'-azobis(2,4-dimethylvaleronitrile) was added to the mixture to prepare a polymerizable monomer composition.

The polymerizable monomer composition was stirred in the aqueous dispersion medium at an internal temperature of 70° C. in a $N_2$ atmosphere for 15 minutes. The number of rotation of the high-speed mixer was maintained at 12,000 rpm. The polymerizable monomer composition was granulated. After that, the mixer was replaced with a propeller impeller blade. The propeller impeller blade was rotated at 50 rpm. The temperature was maintained at 70° C. for 10 hours to complete the polymerization.

After the completion of the polymerization, the suspension was cooled. Hydrochloric acid was then added to the suspension. The suspension was thoroughly washed. After repeated filtering and washing with water, the suspension was dried to form magnetic toner particles 25.

The magnetic toner particles 25 were mixed with an external additive in the same manner as in the Production Example 1 of the magnetic toner to form a comparative magnetic toner 12. Table 7 shows the physical properties of the comparative magnetic toner 12.

TABLE 6-1

| | | External addition apparatus | Premixing conditions (Power (number of rotation), treatment time) |
|---|---|---|---|
| Magnetic toner 1 | Magnetic toner particles 1 | FIG. 4 | 0.10 W/g (150 rpm), 1 min |
| Magnetic toner 2 | Magnetic toner particles 2 | FIG. 4 | 0.10 W/g (150 rpm), 1 min |
| Magnetic toner 3 | Magnetic toner particles 3 | FIG. 4 | 0.10 W/g (150 rpm), 1 min |
| Magnetic toner 4 | Magnetic toner particles 4 | FIG. 4 | 0.10 W/g (150 rpm), 1 min |
| Magnetic toner 5 | Magnetic toner particles 5 | FIG. 4 | 0.10 W/g (150 rpm), 1 min |
| Magnetic toner 6 | Magnetic toner particles 6 | FIG. 4 | 0.10 W/g (150 rpm), 1 min |
| Magnetic toner 7 | Magnetic toner particles 7 | FIG. 4 | 0.10 W/g (150 rpm), 1 min |
| Magnetic toner 8 | Magnetic toner particles 8 | FIG. 4 | 0.10 W/g (150 rpm), 1 min |
| Magnetic toner 9 | Magnetic toner particles 9 | FIG. 4 | 0.10 W/g (150 rpm), 1 min |
| Magnetic toner 10 | Magnetic toner particles 10 | FIG. 4 | 0.10 W/g (150 rpm), 1 min |
| Magnetic toner 11 | Magnetic toner particles 11 | FIG. 4 | 0.10 W/g (150 rpm), 1 min |
| Magnetic toner 12 | Magnetic toner particles 12 | FIG. 4 | 0.10 W/g (150 rpm), 1 min |
| Magnetic toner 13 | Magnetic toner particles 13 | FIG. 4 | 0.10 W/g (150 rpm), 1 min |
| Magnetic toner 14 | Magnetic toner particles 14 | FIG. 4 | 0.10 W/g (150 rpm), 1 min |
| Magnetic toner 15 | Magnetic toner particles 15 | FIG. 4 | 0.10 W/g (150 rpm), 1 min |
| Magnetic toner 16 | Magnetic toner particles 16 | FIG. 4 | 0.10 W/g (150 rpm), 1 min |
| Magnetic toner 17 | Magnetic toner particles 17 | FIG. 4 | 0.10 W/g (150 rpm), 1 min |
| Magnetic toner 18 | Magnetic toner particles 18 | FIG. 4 | 0.10 W/g (150 rpm), 1 min |
| Magnetic toner 19 | Magnetic toner particles 19 | FIG. 4 | 0.10 W/g (150 rpm), 1 min |
| Magnetic toner 20 | Magnetic toner particles 1 | FIG. 4 | 0.10 W/g (150 rpm), 1 min |
| Magnetic toner 21 | Magnetic toner particles 1 | FIG. 4 | 0.10 W/g (150 rpm), 1 min |
| Magnetic toner 22 | Magnetic toner particles 1 | FIG. 4 | 0.10 W/g (150 rpm), 1 min |
| Magnetic toner 23 | Magnetic toner particles 1 | FIG. 4 | 0.06 W/g (50 rpm), 1 min |
| Magnetic toner 24 | Magnetic toner particles 1 | FIG. 4 | 0.06 W/g (50 rpm), 1 min |

TABLE 6-1-continued

| | | External addition apparatus | Premixing conditions (Power (number of rotation), treatment time) |
|---|---|---|---|
| Magnetic toner 25 | Magnetic toner particles 1 | FIG. 4 | 0.10 W/g (150 rpm), 1 min |
| Magnetic toner 26 | Magnetic toner particles 1 | FIG. 4 | 0.10 W/g (150 rpm), 1 min |
| Magnetic toner 27 | Magnetic toner particles 1 | FIG. 4 | 0.10 W/g (150 rpm), 1 min |
| Magnetic toner 28 | Magnetic toner particles 1 | FIG. 4 | 0.10 W/g (150 rpm), 1 min |
| Magnetic toner 29 | Magnetic toner particles 20 | FIG. 4 | 0.10 W/g (150 rpm), 1 min |
| Magnetic toner 30 | Magnetic toner particles 21 | FIG. 4 | 0.10 W/g (150 rpm), 1 min |

TABLE 6-2

| | External addition conditions for first stage | | |
|---|---|---|---|
| | Type | Amount (parts by mass) | Power (number of rotation), treatment time |
| Magnetic toner 1 | Silica fine particles 1 | 0.4 | 0.60 W/g (1400 rpm), 3 min |
| Magnetic toner 2 | Silica fine particles 1 | 0.4 | 0.60 W/g (1400 rpm), 3 min |
| Magnetic toner 3 | Silica fine particles 1 | 0.4 | 0.60 W/g (1400 rpm), 3 min |
| Magnetic toner 4 | Silica fine particles 1 | 0.4 | 0.60 W/g (1400 rpm), 3 min |
| Magnetic toner 5 | Silica fine particles 1 | 0.4 | 0.60 W/g (1400 rpm), 3 min |
| Magnetic toner 6 | Silica fine particles 1 | 0.4 | 0.60 W/g (1400 rpm), 3 min |
| Magnetic toner 7 | Silica fine particles 1 | 0.4 | 0.60 W/g (1400 rpm), 3 min |
| Magnetic toner 8 | Silica fine particles 1 | 0.4 | 0.60 W/g (1400 rpm), 3 min |
| Magnetic toner 9 | Silica fine particles 1 | 0.4 | 0.60 W/g (1400 rpm), 3 min |
| Magnetic toner 10 | Silica fine particles 1 | 0.4 | 0.60 W/g (1400 rpm), 3 min |
| Magnetic toner 11 | Silica fine particles 1 | 0.4 | 0.60 W/g (1400 rpm), 3 min |
| Magnetic toner 12 | Silica fine particles 1 | 0.4 | 0.60 W/g (1400 rpm), 3 min |
| Magnetic toner 13 | Silica fine particles 1 | 0.4 | 0.60 W/g (1400 rpm), 3 min |
| Magnetic toner 14 | Silica fine particles 1 | 0.4 | 0.60 W/g (1400 rpm), 3 min |
| Magnetic toner 15 | Silica fine particles 1 | 0.4 | 0.60 W/g (1400 rpm), 3 min |
| Magnetic toner 16 | Silica fine particles 1 | 0.4 | 0.60 W/g (1400 rpm), 3 min |
| Magnetic toner 17 | Silica fine particles 1 | 0.4 | 0.60 W/g (1400 rpm), 3 min |
| Magnetic toner 18 | Silica fine particles 1 | 0.4 | 0.60 W/g (1400 rpm), 3 min |
| Magnetic toner 19 | Silica fine particles 1 | 0.4 | 0.60 W/g (1400 rpm), 3 min |
| Magnetic toner 20 | Silica fine particles 1 | 0.4 | 0.60 W/g (1400 rpm), 3 min |
| Magnetic toner 21 | Silica fine particles 1 | 0.4 | 0.60 W/g (1400 rpm), 3 min |
| Magnetic toner 22 | Silica fine particles 1 | 0.4 | 0.60 W/g (1400 rpm), 3 min |
| Magnetic toner 23 | Silica fine particles 1 | 0.4 | 0.60 W/g (1400 rpm), 3 min |
| Magnetic toner 24 | Silica fine particles 1 | 0.4 | 0.60 W/g (1400 rpm), 3 min |
| Magnetic toner 25 | Silica fine particles 2 | 0.4 | 0.60 W/g (1400 rpm), 3 min |

TABLE 6-2-continued

| | External addition conditions for first stage | | |
|---|---|---|---|
| | Type | Amount (parts by mass) | Power (number of rotation), treatment time |
| Magnetic toner 26 | Silica fine particles 3 | 0.4 | 0.60 W/g (1400 rpm), 3 min |
| Magnetic toner 27 | Silica fine particles 4 | 0.4 | 0.60 W/g (1400 rpm), 3 min |
| Magnetic toner 28 | Silica fine particles 5 | 0.4 | 0.60 W/g (1400 rpm), 3 min |
| Magnetic toner 29 | Silica fine particles 1 | 0.4 | 0.60 W/g (1400 rpm), 3 min |
| Magnetic toner 30 | Silica fine particles 1 | 0.4 | 0.60 W/g (1400 rpm), 3 min |

TABLE 6-3

| | External addition conditions for second stage | | |
|---|---|---|---|
| | Type | Amount (parts by mass) | Power (number of rotation), treatment time |
| Magnetic toner 1 | Silica fine particles 1 | 0.3 | 0.60 W/g (1400 rpm), 2 min |
| Magnetic toner 2 | Silica fine particles 1 | 0.3 | 0.60 W/g (1400 rpm), 2 min |
| Magnetic toner 3 | Silica fine particles 1 | 0.3 | 0.60 W/g (1400 rpm), 2 min |
| Magnetic toner 4 | Silica fine particles 1 | 0.3 | 0.60 W/g (1400 rpm), 2 min |
| Magnetic toner 5 | Silica fine particles 1 | 0.3 | 0.60 W/g (1400 rpm), 2 min |
| Magnetic toner 6 | Silica fine particles 1 | 0.3 | 0.60 W/g (1400 rpm), 2 min |
| Magnetic toner 7 | Silica fine particles 1 | 0.3 | 0.60 W/g (1400 rpm), 2 min |
| Magnetic toner 8 | Silica fine particles 1 | 0.3 | 0.60 W/g (1400 rpm), 2 min |
| Magnetic toner 9 | Silica fine particles 1 | 0.3 | 0.60 W/g (1400 rpm), 2 min |
| Magnetic toner 10 | Silica fine particles 1 | 0.3 | 0.60 W/g (1400 rpm), 2 min |
| Magnetic toner 11 | Silica fine particles 1 | 0.3 | 0.60 W/g (1400 rpm), 2 min |
| Magnetic toner 12 | Silica fine particles 1 | 0.3 | 0.60 W/g (1400 rpm), 2 min |
| Magnetic toner 13 | Silica fine particles 1 | 0.3 | 0.60 W/g (1400 rpm), 2 min |
| Magnetic toner 14 | Silica fine particles 1 | 0.3 | 0.60 W/g (1400 rpm), 2 min |
| Magnetic toner 15 | Silica fine particles 1 | 0.3 | 0.60 W/g (1400 rpm), 2 min |
| Magnetic toner 16 | Silica fine particles 1 | 0.3 | 0.60 W/g (1400 rpm), 2 min |
| Magnetic toner 17 | Silica fine particles 1 | 0.3 | 0.60 W/g (1400 rpm), 2 min |
| Magnetic toner 18 | Silica fine particles 1 | 0.3 | 0.60 W/g (1400 rpm), 2 min |
| Magnetic toner 19 | Silica fine particles 1 | 0.3 | 0.60 W/g (1400 rpm), 2 min |
| Magnetic toner 20 | Silica fine particles 1 | 0.3 | 0.60 W/g (1400 rpm), 2 min |
| Magnetic toner 21 | Silica fine particles 1 | 0.2 | 0.60 W/g (1400 rpm), 2 min |
| Magnetic toner 22 | Silica fine particles 1 | 0.4 | 0.60 W/g (1400 rpm), 2 min |
| Magnetic toner 23 | Silica fine particles 1 | 0.2 | 0.60 W/g (1400 rpm), 2 min |
| Magnetic toner 24 | Silica fine particles 1 | 0.3 | 0.60 W/g (1400 rpm), 2 min |
| Magnetic toner 25 | Silica fine particles 2 | 0.3 | 0.60 W/g (1400 rpm), 2 min |
| Magnetic toner 26 | Silica fine particles 3 | 0.3 | 0.60 W/g (1400 rpm), 2 min |

TABLE 6-3-continued

| | External addition conditions for second stage | | |
|---|---|---|---|
| | Type | Amount (parts by mass) | Power (number of rotation), treatment time |
| Magnetic toner 27 | Silica fine particles 4 | 0.3 | 0.60 W/g (1400 rpm), 2 min |
| Magnetic toner 28 | Silica fine particles 5 | 0.3 | 0.60 W/g (1400 rpm), 2 min |
| Magnetic toner 29 | Silica fine particles 1 | 0.3 | 0.60 W/g (1400 rpm), 2 min |
| Magnetic toner 30 | Silica fine particles 1 | 0.3 | 0.60 W/g (1400 rpm), 2 min |

TABLE 6-4

| | | External addition apparatus | Premixing conditions (Power (number of rotation), treatment time) |
|---|---|---|---|
| Comparative magnetic toner 1 | Magnetic toner particles 1 | Henschel | No premixing |
| Comparative magnetic toner 2 | Magnetic toner particles 1 | Henschel | No premixing |
| Comparative magnetic toner 3 | Magnetic toner particles 1 | Henschel | No premixing |
| Comparative magnetic toner 4 | Magnetic toner particles 1 | Henschel | No premixing |
| Comparative magnetic toner 5 | Magnetic toner particles 1 | FIG. 4 | 0.10 W/g (150 rpm), 1 min |
| Comparative magnetic toner 6 | Magnetic toner particles 1 | FIG. 4 | 0.10 W/g (150 rpm), 1 min |
| Comparative magnetic toner 7 | Magnetic toner particles 1 | Henschel | 200 rpm, 1 min |
| Comparative magnetic toner 8 | Magnetic toner particles 1 | FIG. 4 | 0.30 W/g (600 rpm), 1 min |
| Comparative magnetic toner 9 | Magnetic toner particles 22 | FIG. 4 | 0.10 W/g (150 rpm), 1 min |
| Comparative magnetic toner 10 | Magnetic toner particles 23 | FIG. 4 | 0.10 W/g (150 rpm), 1 min |
| Comparative magnetic toner 11 | Magnetic toner particles 24 | FIG. 4 | 0.10 W/g (150 rpm), 1 min |
| Comparative magnetic toner 12 | Magnetic toner particles 25 | FIG. 4 | 0.10 W/g (150 rpm), 1 min |

TABLE 6-5

| | External addition conditions for first stage | | |
|---|---|---|---|
| | Type | Amount (parts by mass) | Power (number of rotation), treatment time |
| Comparative magnetic toner 1 | Silica fine particles 1 | 0.6 | 4000 rpm · 3 min |
| Comparative magnetic toner 2 | Silica fine particles 1 | 0.75 | 4000 rpm · 3 min |

TABLE 6-5-continued

| | External addition conditions for first stage | | |
|---|---|---|---|
| | Type | Amount (parts by mass) | Power (number of rotation), treatment time |
| Comparative magnetic toner 3 | Silica fine particles 2 | 0.7 | 4000 rpm · 3 min |
| Comparative magnetic toner 4 | Silica fine particles 5 | 1.2 | 4000 rpm · 3 min |
| Comparative magnetic toner 5 | Silica fine particles 1 | 0.3 | 0.60 W/g (1400 rpm), 3 min |
| Comparative magnetic toner 6 | Silica fine particles 6 | 0.9 | 0.60 W/g (1400 rpm), 3 min |
| Comparative magnetic toner 7 | Silica fine particles 1 | 0.4 | 4000 rpm · 2 min |
| Comparative magnetic toner 8 | Silica fine particles 1 | 0.4 | 0.60 W/g (1400 rpm), 3 min |
| Comparative magnetic toner 9 | Silica fine particles 1 | 0.4 | 0.60 W/g (1400 rpm), 3 min |
| Comparative magnetic toner 10 | Silica fine particles 1 | 0.4 | 0.60 W/g (1400 rpm), 3 min |
| Comparative magnetic toner 11 | Silica fine particles 1 | 0.4 | 0.60 W/g (1400 rpm), 3 min |
| Comparative magnetic toner 12 | Silica fine particles 1 | 0.4 | 0.60 W/g (1400 rpm), 3 min |

TABLE 6-6

| | External addition conditions for second stage | | |
|---|---|---|---|
| | Type | Amount (parts by mass) | Power (number of rotation), treatment time |
| Comparative magnetic toner 1 | None | — | None |
| Comparative magnetic toner 2 | None | — | None |
| Comparative magnetic toner 3 | None | — | None |
| Comparative magnetic toner 4 | None | — | None |
| Comparative magnetic toner 5 | Silica fine particles 1 | 0.1 | 0.60 W/g (1400 rpm), 2 min |
| Comparative magnetic toner 6 | Silica fine particles 6 | 0.4 | 0.60 W/g (1400 rpm), 2 min |
| Comparative magnetic toner 7 | Silica fine particles 1 | 0.3 | 4000 rpm, 1 min |
| Comparative magnetic toner 8 | Silica fine particles 1 | 0.3 | 0.60 W/g (1400 rpm), 2 min |
| Comparative magnetic toner 9 | Silica fine particles 1 | 0.3 | 0.60 W/g (1400 rpm), 2 min |
| Comparative magnetic toner 10 | Silica fine particles 1 | 0.3 | 0.60 W/g (1400 rpm), 2 min |
| Comparative magnetic toner 11 | Silica fine particles 1 | 0.3 | 0.60 W/g (1400 rpm), 2 min |
| Comparative magnetic toner 12 | Silica fine particles 1 | 0.3 | 0.60 W/g (1400 rpm), 2 min |

TABLE 7

| | | D4 | Average | Thermal conductivity | SEC-MALLS measurement | |
|---|---|---|---|---|---|---|
| | | (μm) | circularity | (W/(m · K)) | Mw | Rw/Mw |
| Magnetic toner 1 | Magnetic toner particles 1 | 8.0 | 0.972 | 0.245 | 15000 | $5.0 \times 10^{-3}$ |
| Magnetic toner 2 | Magnetic toner particles 2 | 7.9 | 0.971 | 0.242 | 14500 | $4.9 \times 10^{-3}$ |
| Magnetic toner 3 | Magnetic toner particles 3 | 8.1 | 0.971 | 0.235 | 15000 | $5.1 \times 10^{-3}$ |
| Magnetic toner 4 | Magnetic toner particles 4 | 8.1 | 0.972 | 0.235 | 15500 | $4.8 \times 10^{-3}$ |
| Magnetic toner 5 | Magnetic toner particles 5 | 8.0 | 0.973 | 0.238 | 15000 | $5.0 \times 10^{-3}$ |
| Magnetic toner 6 | Magnetic toner particles 6 | 7.9 | 0.973 | 0.243 | 14500 | $5.0 \times 10^{-3}$ |
| Magnetic toner 7 | Magnetic toner particles 7 | 7.8 | 0.971 | 0.235 | 15000 | $4.9 \times 10^{-3}$ |

TABLE 7-continued

| | | | | | | |
|---|---|---|---|---|---|---|
| Magnetic toner 8 | Magnetic toner particles 8 | 8.1 | 0.972 | 0.235 | 15500 | $4.8 \times 10^{-3}$ |
| Magnetic toner 9 | Magnetic toner particles 9 | 8.0 | 0.971 | 0.250 | 14500 | $5.1 \times 10^{-3}$ |
| Magnetic toner 10 | Magnetic toner particles 10 | 7.9 | 0.970 | 0.250 | 15000 | $4.9 \times 10^{-3}$ |
| Magnetic toner 11 | Magnetic toner particles 11 | 8.0 | 0.971 | 0.232 | 15500 | $4.8 \times 10^{-3}$ |
| Magnetic toner 12 | Magnetic toner particles 12 | 7.9 | 0.972 | 0.234 | 14500 | $5.0 \times 10^{-3}$ |
| Magnetic toner 13 | Magnetic toner particles 13 | 8.0 | 0.971 | 0.250 | 15500 | $4.9 \times 10^{-3}$ |
| Magnetic toner 14 | Magnetic toner particles 14 | 8.1 | 0.971 | 0.235 | 99500 | $5.1 \times 10^{-4}$ |
| Magnetic toner 15 | Magnetic toner particles 15 | 8.0 | 0.972 | 0.250 | 5000 | $1.0 \times 10^{-2}$ |
| Magnetic toner 16 | Magnetic toner particles 16 | 8.1 | 0.971 | 0.237 | 100000 | $4.5 \times 10^{-4}$ |
| Magnetic toner 17 | Magnetic toner particles 17 | 8.1 | 0.973 | 0.247 | 5500 | $1.2 \times 10^{-2}$ |
| Magnetic toner 18 | Magnetic toner particles 18 | 8.0 | 0.972 | 0.247 | 4500 | $1.2 \times 10^{-2}$ |
| Magnetic toner 19 | Magnetic toner particles 19 | 7.8 | 0.971 | 0.237 | 110000 | $4.7 \times 10^{-4}$ |
| Magnetic toner 20 | Magnetic toner particles 1 | 8.0 | 0.972 | 0.247 | 15000 | $5.0 \times 10^{-3}$ |
| Magnetic toner 21 | Magnetic toner particles 1 | 8.0 | 0.972 | 0.246 | 15000 | $5.0 \times 10^{-3}$ |
| Magnetic toner 22 | Magnetic toner particles 1 | 8.0 | 0.972 | 0.242 | 15000 | $5.0 \times 10^{-3}$ |
| Magnetic toner 23 | Magnetic toner particles 1 | 8.0 | 0.972 | 0.246 | 15000 | $5.0 \times 10^{-3}$ |
| Magnetic toner 24 | Magnetic toner particles 1 | 8.0 | 0.972 | 0.244 | 15000 | $5.0 \times 10^{-3}$ |
| Magnetic toner 25 | Magnetic toner particles 1 | 8.0 | 0.972 | 0.240 | 15000 | $5.0 \times 10^{-3}$ |
| Magnetic toner 26 | Magnetic toner particles 1 | 8.0 | 0.972 | 0.247 | 15000 | $5.0 \times 10^{-3}$ |
| Magnetic toner 27 | Magnetic toner particles 1 | 8.0 | 0.972 | 0.246 | 15000 | $5.0 \times 10^{-3}$ |
| Magnetic toner 28 | Magnetic toner particles 1 | 8.0 | 0.972 | 0.249 | 15000 | $5.0 \times 10^{-3}$ |
| Magnetic toner 29 | Magnetic toner particles 20 | 7.8 | 0.971 | 0.230 | 95500 | $5.2 \times 10^{-4}$ |
| Magnetic toner 30 | Magnetic toner particles 21 | 7.9 | 0.972 | 0.270 | 5000 | $1.0 \times 10^{-2}$ |
| Comparative magnetic toner 1 | Magnetic toner particles 1 | 8.0 | 0.972 | 0.246 | 15000 | $5.0 \times 10^{-3}$ |
| Comparative magnetic toner 2 | Magnetic toner particles 1 | 8.0 | 0.972 | 0.243 | 15000 | $5.0 \times 10^{-3}$ |
| Comparative magnetic toner 3 | Magnetic toner particles 1 | 8.0 | 0.972 | 0.239 | 15000 | $5.0 \times 10^{-3}$ |
| Comparative magnetic toner 4 | Magnetic toner particles 1 | 8.0 | 0.972 | 0.247 | 15000 | $5.0 \times 10^{-3}$ |
| Comparative magnetic toner 5 | Magnetic toner particles 1 | 8.0 | 0.972 | 0.251 | 15000 | $5.0 \times 10^{-3}$ |
| Comparative magnetic toner 6 | Magnetic toner particles 1 | 8.0 | 0.972 | 0.250 | 15000 | $5.0 \times 10^{-3}$ |
| Comparative magnetic toner 7 | Magnetic toner particles 1 | 8.0 | 0.972 | 0.247 | 15000 | $5.0 \times 10^{-3}$ |
| Comparative magnetic toner 8 | Magnetic toner particles 1 | 8.0 | 0.972 | 0.246 | 15000 | $5.0 \times 10^{-3}$ |
| Comparative magnetic toner 9 | Magnetic toner particles 22 | 8.1 | 0.971 | 0.275 | 5500 | $1.0 \times 10^{-2}$ |
| Comparative magnetic toner 10 | Magnetic toner particles 23 | 7.8 | 0.970 | 0.219 | 12000 | $6.0 \times 10^{-3}$ |
| Comparative magnetic toner 11 | Magnetic toner particles 24 | 7.9 | 0.971 | 0.225 | 14000 | $7.0 \times 10^{-3}$ |
| Comparative magnetic toner 12 | Magnetic toner particles 25 | 8.0 | 0.970 | 0.211 | 150000 | $3.0 \times 10^{-4}$ |

| | | Coverage X1 (%) | Theoretical coverage X2 (%) | Diffusion index (X1/X2) | Lower limit of diffusion index (−0.0042 × X1 + 0.62) |
|---|---|---|---|---|---|
| Magnetic toner 1 | Magnetic toner particles 1 | 58 | 124 | 0.47 | 0.38 |
| Magnetic toner 2 | Magnetic toner particles 2 | 58 | 124 | 0.47 | 0.38 |
| Magnetic toner 3 | Magnetic toner particles 3 | 58 | 124 | 0.47 | 0.38 |
| Magnetic toner 4 | Magnetic toner particles 4 | 58 | 124 | 0.47 | 0.38 |
| Magnetic toner 5 | Magnetic toner particles 5 | 58 | 124 | 0.47 | 0.38 |
| Magnetic toner 6 | Magnetic toner particles 6 | 58 | 124 | 0.47 | 0.38 |
| Magnetic toner 7 | Magnetic toner particles 7 | 58 | 124 | 0.47 | 0.38 |
| Magnetic toner 8 | Magnetic toner particles 8 | 58 | 124 | 0.47 | 0.38 |
| Magnetic toner 9 | Magnetic toner particles 9 | 58 | 124 | 0.47 | 0.38 |
| Magnetic toner 10 | Magnetic toner particles 10 | 58 | 124 | 0.47 | 0.38 |
| Magnetic toner 11 | Magnetic toner particles 11 | 58 | 124 | 0.47 | 0.38 |
| Magnetic toner 12 | Magnetic toner particles 12 | 58 | 124 | 0.47 | 0.38 |
| Magnetic toner 13 | Magnetic toner particles 13 | 58 | 124 | 0.47 | 0.38 |
| Magnetic toner 14 | Magnetic toner particles 14 | 58 | 124 | 0.47 | 0.38 |
| Magnetic toner 15 | Magnetic toner particles 15 | 58 | 124 | 0.47 | 0.38 |
| Magnetic toner 16 | Magnetic toner particles 16 | 58 | 124 | 0.47 | 0.38 |
| Magnetic toner 17 | Magnetic toner particles 17 | 58 | 124 | 0.47 | 0.38 |
| Magnetic toner 18 | Magnetic toner particles 18 | 58 | 124 | 0.47 | 0.38 |
| Magnetic toner 19 | Magnetic toner particles 19 | 58 | 124 | 0.47 | 0.38 |
| Magnetic toner 20 | Magnetic toner particles 1 | 45 | 89 | 0.51 | 0.43 |
| Magnetic toner 21 | Magnetic toner particles 1 | 50 | 106 | 0.47 | 0.41 |
| Magnetic toner 22 | Magnetic toner particles 1 | 70 | 142 | 0.49 | 0.33 |
| Magnetic toner 23 | Magnetic toner particles 1 | 46 | 106 | 0.43 | 0.43 |
| Magnetic toner 24 | Magnetic toner particles 1 | 51 | 124 | 0.41 | 0.41 |
| Magnetic toner 25 | Magnetic toner particles 1 | 75 | 223 | 0.34 | 0.31 |
| Magnetic toner 26 | Magnetic toner particles 1 | 64 | 159 | 0.40 | 0.35 |
| Magnetic toner 27 | Magnetic toner particles 1 | 46 | 74 | 0.62 | 0.43 |

TABLE 7-continued

| | | | | | |
|---|---|---|---|---|---|
| Magnetic toner 28 | Magnetic toner particles 1 | 43 | 56 | 0.77 | 0.44 |
| Magnetic toner 29 | Magnetic toner particles 20 | 58 | 124 | 0.47 | 0.38 |
| Magnetic toner 30 | Magnetic toner particles 21 | 58 | 124 | 0.47 | 0.38 |
| Comparative magnetic toner 1 | Magnetic toner particles 1 | 43 | 106 | 0.41 | 0.44 |
| Comparative magnetic toner 2 | Magnetic toner particles 1 | 51 | 133 | 0.38 | 0.41 |
| Comparative magnetic toner 3 | Magnetic toner particles 1 | 70 | 223 | 0.31 | 0.33 |
| Comparative magnetic toner 4 | Magnetic toner particles 1 | 41 | 95 | 0.43 | 0.45 |
| Comparative magnetic toner 5 | Magnetic toner particles 1 | 37 | 71 | 0.52 | 0.46 |
| Comparative magnetic toner 6 | Magnetic toner particles 1 | 40 | 82 | 0.49 | 0.45 |
| Comparative magnetic toner 7 | Magnetic toner particles 1 | 42 | 124 | 0.34 | 0.44 |
| Comparative magnetic toner 8 | Magnetic toner particles 1 | 46 | 124 | 0.37 | 0.43 |
| Comparative magnetic toner 9 | Magnetic toner particles 22 | 58 | 124 | 0.47 | 0.38 |
| Comparative magnetic toner 10 | Magnetic toner particles 23 | 58 | 124 | 0.47 | 0.38 |
| Comparative magnetic toner 11 | Magnetic toner particles 24 | 58 | 124 | 0.47 | 0.38 |
| Comparative magnetic toner 12 | Magnetic toner particles 25 | 58 | 124 | 0.47 | 0.38 |

Exemplary Embodiment 1

The following evaluation was performed using the magnetic toner 1. Table 8 shows the results.

Image-Forming Apparatus

LBP-3300 (manufactured by CANON KABUSHIKI KAISHA) was used as an image-forming apparatus and was modified such that the printing speed was changed from 21 to 30 sheets/min. The image-forming apparatus was also modified such that the fixing temperature of a fixing unit was lower by 10° C. than the product temperature controller.

The image-forming apparatus was used to evaluate the developability and fixability of the magnetic toner 1 at a low temperature of 15° C. and at a low humidity of 10% RH. A4-size 80 g/m$^2$ paper sheets were used as printing media. Under the endurance test conditions, horizontal lines were printed on 4000 sheets in an intermittent mode at a printing ratio of 2% in an image forming test.

As a result, high-density images could be consistently printed before and after the endurance test. Thus, the low-temperature offset was good. Table 7 shows the results.

The evaluation methods and criteria in the exemplary embodiments and comparative examples of the present invention will be described below.

<Optical Density>

The optical density was measured by forming a solid image area and measuring the density of the solid image using a Macbeth reflection densitometer (Macbeth). The criteria for the reflection density of a solid image at an early stage of the endurance test (evaluation 1) and after printing of 4000 sheets (evaluation 2) are as follows:

A: Very good (1.46 or more)

B: Good (1.41 to 1.45)

C: Fair (1.36 to 1.40)

D: Poor (1.35 or less)

<Low-Temperature Offset>

The fixing unit was cooled to room temperature (15° C.) initially and after printing of 4000 sheets. A mixed image of 190 μm horizontal lines and a solid area in which the toner coverage per unit area was 0.7 mg/cm$^2$ was subjected to low-temperature offset evaluation. The low-temperature offset was evaluated by visual inspection according to the following criteria.

A: No offset.

B: Slight offset only in the line area.

C: Slight offset in the line area and solid area.

D: Significant offset in the line area or solid area.

Exemplary Embodiments 2 to 30 and Comparative Examples 1 to 12

The magnetic toners 2 to 30 and the comparative magnetic toners 1 to 12 were evaluated under the same conditions as in Exemplary Embodiment 1. Table 8 shows the results.

TABLE 8

| | | Optical density | | Low-temperature offset | |
|---|---|---|---|---|---|
| | | Initial | After 4000 sheets | Initial | After 4000 sheets |
| Exemplary embodiment 1 | Magnetic toner 1 | A (1.53) | A (1.50) | A | A |
| Exemplary embodiment 2 | Magnetic toner 2 | A (1.53) | A (1.49) | A | B |
| Exemplary embodiment 3 | Magnetic toner 3 | A (1.49) | A (1.47) | B | B |
| Exemplary embodiment 4 | Magnetic toner 4 | A (1.48) | A (1.46) | B | B |
| Exemplary embodiment 5 | Magnetic toner 5 | A (1.47) | B (1.45) | B | B |
| Exemplary embodiment 6 | Magnetic toner 6 | A (1.49) | B (1.44) | B | B |
| Exemplary embodiment 7 | Magnetic toner 7 | B (1.45) | B (1.42) | B | B |
| Exemplary embodiment 8 | Magnetic toner 8 | A (1.49) | B (1.44) | A | B |
| Exemplary embodiment 9 | Magnetic toner 9 | A (1.52) | A (1.50) | A | A |
| Exemplary embodiment 10 | Magnetic toner 10 | A (1.50) | A (1.47) | A | A |
| Exemplary embodiment 11 | Magnetic toner 11 | B (1.44) | B (1.41) | B | C |
| Exemplary embodiment 12 | Magnetic toner 12 | C (1.40) | C (1.36) | B | C |
| Exemplary embodiment 13 | Magnetic toner 13 | A (1.53) | A (1.51) | B | C |
| Exemplary embodiment 14 | Magnetic toner 14 | A (1.52) | B (1.45) | B | C |
| Exemplary embodiment 15 | Magnetic toner 15 | B (1.45) | C (1.40) | B | B |

TABLE 8-continued

| | | Optical density | | Low-temperature offset | |
|---|---|---|---|---|---|
| | | Initial | After 4000 sheets | Initial | After 4000 sheets |
| Exemplary embodiment 16 | Magnetic toner 16 | B (1.45) | B (1.41) | C | C |
| Exemplary embodiment 17 | Magnetic toner 17 | B (1.44) | C (1.38) | B | C |
| Exemplary embodiment 18 | Magnetic toner 18 | B (1.45) | C (1.36) | B | C |
| Exemplary embodiment 19 | Magnetic toner 19 | B (1.45) | C (1.40) | C | C |
| Exemplary embodiment 20 | Magnetic toner 20 | A (1.50) | B (1.45) | B | B |
| Exemplary embodiment 21 | Magnetic toner 21 | A (1.53) | A (1.47) | A | B |
| Exemplary embodiment 22 | Magnetic toner 22 | A (1.53) | A (1.51) | B | B |
| Exemplary embodiment 23 | Magnetic toner 23 | B (1.45) | B (1.41) | B | B |
| Exemplary embodiment 24 | Magnetic toner 24 | B (1.44) | B (1.42) | B | B |
| Exemplary embodiment 25 | Magnetic toner 25 | B (1.45) | B (1.41) | B | C |
| Exemplary embodiment 26 | Magnetic toner 26 | A (1.49) | B (1.45) | A | B |
| Exemplary embodiment 27 | Magnetic toner 27 | B (1.45) | B (1.42) | B | B |
| Exemplary embodiment 28 | Magnetic toner 28 | B (1.45) | C (1.40) | B | C |
| Exemplary embodiment 29 | Magnetic toner 29 | C (1.40) | C (1.36) | C | C |
| Exemplary embodiment 30 | Magnetic toner 30 | B (1.45) | C (1.36) | B | C |
| Comparative example 1 | Comparative magnetic toner 1 | B (1.45) | C (1.36) | C | D |
| Comparative example 2 | Comparative magnetic toner 2 | B (1.44) | C (1.39) | B | D |
| Comparative example 3 | Comparative magnetic toner 3 | B (1.44) | C (1.38) | C | D |
| Comparative example 4 | Comparative magnetic toner 4 | B (1.45) | D (1.35) | B | D |
| Comparative example 5 | Comparative magnetic toner 5 | C (1.38) | D (1.34) | B | D |
| Comparative example 6 | Comparative magnetic toner 6 | C (1.38) | D (1.34) | C | C |
| Comparative example 7 | Comparative magnetic toner 7 | B (1.41) | C (1.36) | C | D |
| Comparative example 8 | Comparative magnetic toner 8 | B (1.45) | C (1.36) | B | D |
| Comparative example 9 | Comparative magnetic toner 9 | B (1.45) | C (1.37) | B | D |
| Comparative example 10 | Comparative magnetic toner 10 | B (1.44) | C (1.38) | C | D |
| Comparative example 11 | Comparative magnetic toner 11 | B (1.44) | C (1.40) | C | D |
| Comparative example 12 | Comparative magnetic toner 12 | C (1.39) | C (1.36) | D | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-260383, filed Dec. 17, 2013, which is hereby incorporated by reference herein in its entirety.

What is claimed is:

1. A magnetic toner comprising:

magnetic toner particles, each of which contains a binder resin, a magnetic material and a release agent; and silica fine particles, wherein the magnetic toner has a thermal conductivity in the range of 0.230 to 0.270 W/(m·K), primary particles of the silica fine particles have a number-average particle diameter (D1) in the range of 5 to 20 nm, the coverage X1 of the magnetic toner surface by the silica fine particles ranges from 40% to 75% by area, as determined using an X-ray photoelectron spectrometer (ESCA), and the diffusion index represented by the following formula 1 satisfies the following formula 2:

$$\text{Diffusion index}=X1/X2 \quad (1)$$

$$\text{Diffusion index}\geq -0.0042\times X1+0.62 \quad (2)$$

wherein X2 denotes the theoretical coverage of the magnetic toner surface by the silica fine particles.

2. The magnetic toner according to claim 1, wherein the weight-average molecular weight Mw of tetrahydrofuran-soluble matter of the magnetic toner at 25° C. ranges from 5000 to 100,000, and the ratio (Rw/Mw) of the average radius of gyration Rw to the weight-average molecular weight Mw of the tetrahydrofuran-soluble matter ranges from $5.0\times10^{-4}$ to $1.0\times10^{-2}$, as determined by size exclusion chromatography-multi-angle laser light scattering (SEC-MALLS).

3. The magnetic toner according to claim 2, wherein the magnetic toner has an average radius of gyration Rw in the range of 20 to 70 nm.

4. The magnetic toner according to claim 1, wherein the release agent has a melting point in the range of 60° C. to 140° C., the melting point being a peak temperature of a maximum endothermic peak measured using a differential scanning calorimeter (DSC) during heating.

* * * * *